US007419239B2

(12) United States Patent
Brown et al.

(10) Patent No.: US 7,419,239 B2
(45) Date of Patent: Sep. 2, 2008

(54) PRINTING APPARATUS

(75) Inventors: Steven Robert Brown, Spondon (GB); Martin McNestry, Heanor (GB); Steven John Buckby, East Bridgford (GB); David John Byrne, Beeston (GB)

(73) Assignee: Zipher Limited, Nottingham (GB)

( * ) Notice: Subject to any disclaimer, the term of this patent is extended or adjusted under 35 U.S.C. 154(b) by 160 days.

(21) Appl. No.: 10/415,676

(22) PCT Filed: Oct. 5, 2001

(86) PCT No.: PCT/GB01/04448

§ 371 (c)(1),
(2), (4) Date: Jan. 20, 2004

(87) PCT Pub. No.: WO02/36347

PCT Pub. Date: May 10, 2002

(65) Prior Publication Data

US 2004/0104959 A1 Jun. 3, 2004

(30) Foreign Application Priority Data

Oct. 31, 2000 (GB) ..... 0026585.0
Nov. 22, 2000 (GB) ..... 0028451.3

(51) Int. Cl.
*B41J 2/165* (2006.01)
*B41J 29/38* (2006.01)

(52) U.S. Cl. ..... 347/25; 347/10

(58) Field of Classification Search ..... 347/7, 347/10, 11, 25, 23, 48, 50, 53, 85
See application file for complete search history.

(56) References Cited

U.S. PATENT DOCUMENTS 4,123,761 A 10/1978 Kimura et al.

(Continued)

FOREIGN PATENT DOCUMENTS

EP 0604029 6/1994

(Continued)

OTHER PUBLICATIONS

Patent Abstracts of Japan, vol. 003, No. 153 (E-159), Dec. 15, 1979 & JP 54 133335, Oct. 17, 1979.

Patent Abstracts of Japan, vol. 013, No. 193 (M-822), May 9, 1989 & JP 01 018641, Jan. 23, 1989.

*Primary Examiner*—Shih-Wen Hsieh
(74) *Attorney, Agent, or Firm*—Nixon & Vanderhye P.C.

(57) ABSTRACT

An inkjet printer in which a printhead defines an elongate array of orifices from which jets of ink are projected into a space within which substrates to be printed are presented. An air curtain generator fixed in position relative to the printhead extends along one side only of the array of orifices so as to direct a curtain of air across the array a of orifices and across an open portion of the printhead on the side of the array of orifices remote from the air curtain generator. The air curtain cleans the printhead. A pressure pulse may be applied to ink within the printhead sufficient to discharge ink form each orifice when not in use to project ink. The pressure pulse has a relatively rapidly rising leading edge and a relatively slowly falling edge. An ink reservoir is coupled to the printhead for supplying ink to the orifices. The orifices may be arranged in at least two vertically offset groups, the reservoir being divided into vertically offset reservoir sections including a lowermost section and an upper section with each reservoir section being coupled exclusively to a respective group of orifices. The upper reservoir section is arranged to overflow into the immediately adjacent reservoir section which is spaced therebelow. Each reservoir section includes an ink level detector, and ink is supplied to the reservoir section which is vertically uppermost if any level detector detects an ink level below a predetermined level.

69 Claims, 12 Drawing Sheets

U.S. PATENT DOCUMENTS

| | | | | | |
|---|---|---|---|---|---|
| 4,361,845 | A | | 11/1982 | Smith | |
| 4,367,479 | A | | 1/1983 | Bower | |
| 4,376,283 | A | | 3/1983 | Bower | |
| 4,411,706 | A | | 10/1983 | Wallace et al. | |
| 4,417,259 | A | | 11/1983 | Maeda | |
| 4,479,136 | A | | 10/1984 | Lewis et al. | |
| 4,609,925 | A | | 9/1986 | Nozu et al. | |
| 4,829,318 | A | | 5/1989 | Racicot et al. | |
| 4,901,095 | A | | 2/1990 | Perra, Jr. et al. | |
| 4,970,535 | A | | 11/1990 | Oswald et al. | |
| 5,115,250 | A | | 5/1992 | Harmon et al. | |
| 5,138,334 | A | | 8/1992 | Rowe et al. | |
| 5,184,147 | A | | 2/1993 | MacLane et al. | |
| 5,343,226 | A | | 8/1994 | Niedermeyer et al. | |
| 5,489,925 | A | | 2/1996 | Brooks et al. | |
| 5,528,271 | A | | 6/1996 | Ebisawa | |
| 5,559,539 | A | | 9/1996 | Vo et al. | |
| 5,570,117 | A | | 10/1996 | Karambelas et al. | |
| 5,594,476 | A | * | 1/1997 | Tokunaga et al. | 347/10 |
| 5,757,396 | A | | 5/1998 | Bruner | |
| 5,774,140 | A | | 6/1998 | English | |
| 5,877,788 | A | * | 3/1999 | Haan et al. | 347/28 |
| 5,910,810 | A | | 6/1999 | Brooks et al. | |
| 5,917,508 | A | | 6/1999 | Lopez et al. | |
| 6,033,061 | A | | 3/2000 | Niedermeyer et al. | |
| 6,142,601 | A | | 11/2000 | Sharma et al. | |
| 6,145,952 | A | | 11/2000 | Sharma et al. | |
| 6,196,668 | B1 | * | 3/2001 | Bode | 347/85 |
| 6,312,087 | B1 | | 11/2001 | Imai et al. | |
| 6,406,125 | B1 | | 6/2002 | Jackson | |
| 6,529,845 | B1 | * | 3/2003 | Beck, II | 702/100 |
| 2001/0050697 | A1 | | 12/2001 | Jackson | |
| 2002/0122091 | A1 | | 9/2002 | Jackson | |

FOREIGN PATENT DOCUMENTS

| | | | |
|---|---|---|---|
| EP | 0657290 | | 6/1995 |
| EP | 0 805 034 | | 11/1997 |
| EP | 0784784 | | 12/1998 |
| EP | 1016530 | | 7/2000 |
| EP | 1060894 | | 12/2000 |
| EP | 1162071 | | 12/2001 |
| EP | 1273449 | | 1/2003 |
| GB | 2280149 | | 1/1995 |
| GB | 2 297 726 | | 8/1996 |
| GB | 2312649 | | 11/1997 |
| GB | 2339170 | | 1/2000 |
| JP | 360087054 | A * | 5/1985 |
| WO | WO 89 04255 | | 5/1989 |
| WO | WO 96 35584 | | 11/1996 |
| WO | WO 97/28001 | | 8/1997 |
| WO | WO 97 30850 | | 8/1997 |
| WO | WO 97/44194 | | 11/1997 |
| WO | WO 98/30394 | | 7/1998 |
| WO | WO 99/04979 | | 2/1999 |
| WO | WO 99 11933 | | 3/1999 |
| WO | WO 00 43209 | | 7/2000 |
| WO | WO 00 68016 | | 11/2000 |
| WO | WO 01 60623 | | 8/2001 |

* cited by examiner

PRINTING APPARATUS

This invention relates to inkjet-printing apparatus, and in particular to apparatus for cleaning, maintaining and supplying ink to a printhead of an ink jet printer.

Types of printers exist which make use of so called piezo-electric ink-jet printing technology. A piezo-electric printhead (also sometime referred to as PZT printhead) of such a printer is characterised in that it has a plurality of miniature jetting chambers or "jets" closely arranged in an array. Each jet is arranged to project ink from a respective one of an array of orifices defined by the printhead, and the jets are selectively energised by a controller to project (or not project as the case may be) "pixels" of ink. The ink is projected onto a substrate to be printed, relative movement between the printhead and the substrate resulting in ink projected from one orifice being deposited along an elongate path on the substrate. The printhead is arranged within the printer such that the array of jets extends at a predetermined angle (for example 90°) to the direction of the relative motion between the printhead and the substrate. The controller selects a first combination of jets through which ink is projected, and then a second combination of jets, etc, relative movement between the substrate and the printhead resulting in a two dimensional image being printed on the substrate.

Piezo-electric ink jet printers are used in many office and industrial applications. Industrial printing applications include packaging printers, which print directly onto substrates such as cardboard boxes, trays, flexible film and labels.

Current industrial printers use a range of different inks in conjunction with a variety of different models of piezo-electric printheads. Some utilise liquid ink, others utilise solid ink which is heated so as to phase-change to liquid within the printer, the ink being liquid at the time it is ejected from the jets.

Printhead arrays used in industrial applications typically range in length from 10 mm to 70 mm. In high resolution printheads, as many as 512 jets are arranged in a 70 mm long linear array on a printhead. It will therefore be appreciated that the jets are very small. Each jet ejects a very small (picolitre order of magnitude) droplet of ink each time it is energised by the controller.

Whilst such printers can produce fine resolution images, they are subject to image degradation due to one or more of the jets becoming blocked by dust or other contaminant, or otherwise fail as the result of a jet not being filled with ink to adjacent the orifice at the time the ink is to be projected (commonly referred to as a "de-primed" state), so that they no longer eject ink properly. This jet failure (often referred to as "jet drop out") results in a degraded image having one or several unprinted lines running throughout the printed image in the direction of relative movement between the printhead and the substrate. A contaminant that does not completely block a jet can also cause problems by causing the deflection of a droplet of ink as it is ejected from the jet, such deflection resulting in a distorted image.

In certain industrial applications such as printing onto cardboard boxes or trays, a significant contributor of contamination is dust either airborne or resting on the surface of the cardboard. The piezo-electric printing process requires the printhead jet array face to come into very close proximity with the target substrate. Furthermore there can be a build up of static electricity in the production process in the area around the printer, which can result in dust being positively attracted to the print face. Thus particularly in industrial applications contamination of jets is a major problem.

Given the problems referred to above, it is common practice, particularly in industrial applications, to follow a procedure often referred to as "purging" in order to maintain or restore the proper function of the jets in the printhead. The purging procedure involves forcing ink through all the jets of the printhead, with the intention of flushing out and removing any contaminants from the jets and ensuring that the jets are correctly printed, that is filled with ink to adjacent the orifices. After performance of the purging procedure, the jets should be in a stable working condition (commonly referred to as a "printed" state) such that high quality printing can be commenced or recommenced.

In known industrial printers, the purging procedure is typically initiated by the user. The purging action is typically brought about by putting an ink supply to the printhead under sufficient positive pressure to force some ink through all the jets of the printhead. This can be achieved by the user applying pressure manually to an ink reservoir communicating with ink in the printhead, or by applying pressure using a pump to the reservoir. Typically, positive pressure is applied for a period of a few seconds.

In industrial applications, such as printing onto cardboard boxes or trays, the printhead is often mounted adjacent a production line, so that the boxes pass in close proximity to the printhead. In these applications the printhead is most often mounted such the jet array is vertical, or at some predetermined angle to the horizontal. When ink is purged through the jets, it collects on an orifice plate of the printhead in which the jet orifices are formed, and begins to flow down the orifice plate under gravity. The flow of ink is relatively slow, the ink taking a number of seconds to flow down to the bottom of the printhead. Of course, the longer the printhead in the vertical direction, the longer the downward flow of ink takes.

Since a relatively large volume of ink (as compared with the volume of ink normally projected by an individual jet) is purged out of the orifices, the jets are not able to jet ink properly to create an image until substantially all the ink has flowed down away from the jets or has otherwise been moved away from the jets. Generally steps are taken to remove purged ink. For example, purged ink is soaked into a cloth which is then disposed off. This can easily result in ink being dripped onto the floor or surrounding factory equipment, creating unwanted mess, which is difficult to remove and clean. The wasted purged ink is a considerable percentage of the total ink consumption. Furthermore, wiping away purged ink in this way typically takes several seconds. The total time taken to complete a single ink purge procedure is thus substantial.

Accordingly, although the purge procedure is generally successful in recovering jets, it can cause a number of problems. Firstly the purge procedure generally requires manual intervention and takes at least several seconds. It will be appreciated that the printhead cannot properly print images whilst it is being purged. Therefore it is therefore often necessary to stop an associated process (for example a production line) until the purge procedure has been completed. Secondly, the amount of ink consumed in the process is relatively large, often being several times greater than the amount of ink used to print an image.

Various proposals for improving ink purge procedures have been proposed. For example, one known purging procedure described in British Patent GB 2339170 provides an aperture in a plate defining the orifices from which ink is projected, the aperture being positioned in use vertically beneath the jets. Either in response to detection of jet dropout requiring remedial treatment, or at intervals for maintenance purposes before jet dropout an ink feed reservoir is pressurized with a pump or manually to cause ink to flow out of the printhead orifices. After purging, ink flows down the orifice plate under gravity towards the aperture. The ink is sucked through the aperture and ducted to a reservoir for filtering and subsequent re-use. Ink wastage is thus reduced, but as the ink flows only under gravity it will be appreciated that it takes at least several seconds for the ink to flow away from the jets to the aperture. Even on production lines operating at modest speed the time taken for purged is to be removed from the orifice plate is too long for purging to be carried out between two successive product print cycles. Thus it will be appreciated that this known purging procedure takes too long to avoid the necessity of stopping the production line whilst purging occurs.

International patent specification WO 89/04255 describes an ink jet priming system in which pressurized air is used to purge ink into an ink collection system which is located adjacent ink jets to be purged only during the purging procedure. During purging, a sufficiently high pressure is applied to the ink such that it streams into the collection system rather than trickling out of the jets. Thus purged ink is removed from adjacent the jets without requiring manual intervention, but only as the result of providing a complex mechanical assembly to achieve the necessary relative movement between the jets and the ink collection system. The described system has the capability of controlling the shape of a pressure pulse that is used to purge ink from the jets, that pulse having a "soft" profile (slowly rising leading edge and rapidly falling trailing edge) or a "hard" profile (rapidly rising leading edge and rapidly falling trailing edge). In the described examples, the slowly rising leading edge part of the pulse has a duration of 100 milliseconds or 200 milliseconds. It is stated that it is desirable to abruptly terminate the supply of air which causes the ink to flow out of the jets (the rapidly falling trailing edge of the pulses). This is said to cause the streaming of ink from the jets to abruptly cease. It is stated that the described arrangement eliminates the trickling of ink from the jets.

European Patent Specification EP 1016530 describes another arrangement for cleaning and preventing obstruction of the orifice plate of an ink jet printer. The device described incorporates a cleaning assembly which is moveable relative to the orifice plate to a position in which a closed chamber is formed over the orifice plate. A fluid is then pumped through the closed chamber so as to clean any contaminants from the orifice plate surface or any individual orifice in the plates.

The highly complex arrangement of EP 1016530 is presented as an improvement of an earlier proposal which is described in U.S. Pat. No. 4,970,535. That U.S. patent discloses an arrangement in which an inkjet orifice plate cleaner is moved into engagement with the orifice plate so as to provide a closed air passageway through which air is directed to provide the required cleaning effect. Once again the described assembly is complex, requiring relative movement between a "ready to print" confirmation and a "cleaning" configuration. Furthermore it is stated in EP 1016530 that air cleaning in the manner suggested in U.S. Pat. No. 4,970,535 does not provide acceptable results.

European patent specification EP 604029 describes another cleaning arrangement in which an air curtain is directed across an ink jet orifice plate. The jets are located behind an aperture in the plate, projected ink passing through that aperture before being deposited upon a substrate to be printed. Air flows between the apertured plate and the orifice plate and thus across the orifices. The airflow is maintained during printing at an airflow rate that is sufficiently slow as to not significantly effect ink projection. The purpose of this airflow is to avoid the build up of contaminants or the orifice plate, not to clean ink off the orifice plate. Cleaning of the printing head requires a separate operation, involving release of a latch mechanism to enable the orifice plate to swing away from a "ready to print" position to a position in which it can be readily cleaned. Positioning the orifice plate behind another plate means that none of the orifice plate is open to the space through which the substrate to be printed travels relative to the orifice plate. As a result the distance through which ink must be projected is relatively large.

U.S. Pat. No. 5,184,147 describes an inkjet printhead maintenance system incorporating various relatively moveable components including a slowly moving elongate mechanical wiper and an "air knife". The air life generates a narrow stream of air which is swept across the orifice plate. Thus the air life requires relative movement between the structure generating the narrow stream of air and the orifice plate. Furthermore, the air knife is provided as only one of a number of complimentary cleaning mechanisms in an overall assembly of great complexity.

In the absence of a simple fast operating jet pinging systems in many applications purging generally requires the stopping of an associated process, for example a production line. As a result, users prefer to initiate the purge procedure as seldom as possible. This can result in a compromise between production line efficiently on the one hand and image quality on the other. In practice, it is common for operators to wait for printing quality to deteriorate significantly before initiating the purge procedure. It will also be appreciated that the longer dust and debris is allowed to build up on the printhead, the more purging and cleaning of the jets is likely to be necessary to fully restore print quality.

It is an object of the present invention to provide an improved ink jet printing apparatus which addresses one or more of the problems outlined above.

According to a first aspect of the present invention, there is provided an apparatus for cleaning an inkjet printer printhead which defines an elongate array of orifices front which in use jets of ink are projected into a space within which substrates to be printed are presented, comprising an air curtain generating means fixed in position relative to the printhead and extending along one side only of the array of orifices so as to direct a curtain of air across the array of orifices and across a portion of the printhead which is open to the said space and which is on the side of the array of orifices remote from the air curtain generating means.

The apparatus defined in the preceding paragraph makes it possible to rapidly displace purged ink from the printhead using an assembly which is permanently fixed in position and which is not interposed between the printhead and a substrate onto which ink is to be projected from the printhead. A compact and mechanically simple printing arrangement is thus provided which can be rapidly cleaned, enabling cleaning to be performed after completion of one printing operation and before the initiation of a subsequent printing operation even if the two printing operations are spaced by only a relatively short period of time for example 1 second or less.

According to a second aspect of the present invention, there is provided an apparatus for maintaining an inkjet printer printhead in a working state, the printer defining an array of orifices from which in use jets of ink are projected, the apparatus comprising means for applying a pressure pulse to ink within the printhead sufficient to discharge ink from each orifice, the pressure pulse having a relatively rapidly rising leading edge and a relative slowly falling trailing edge.

The use of a pulse shape as defined above ensures that contaminants are readily dislodged from the jets by the flow of ink generated by the pulse and yet there is minimal risk of the jets becoming de-primed when the pulse is terminated.

According to a third aspect of the present invention, there is provided all inkjet printer ink supply apparatus for supplying ink to a printhead defining an array of orifices from which ink may be projected, the apparatus comprising a reservoir coupled to the printhead for supplying ink to the orifices, and means for supplying ink to the reservoir, the orifices being arranged in at least two vertically offset groups, the reservoir being divided into vertically offset reservoir sections including a lowermost section and at least one upper section with each reservoir section being coupled exclusively to a respective group of orifices, and the or each upper reservoir section being arranged to overflow into the immediately adjacent reservoir section which is spaced therebelow, wherein each reservoir section includes means for detecting the level of ink within that section, and the ink supply means is arranged to deliver ink to the reservoir section which is vertically uppermost if any level detecting means detects an ink level in the respective reservoir section below a predetermined level.

An arrangement as defined in the preceding paragraph makes it possible to replenish a series of ink reservoirs each of which feeds a different set of jets using only one arrangement for delivering ink to all the reservoirs.

Preferably, the air curtain is directed to flow in a direction perpendicular to the elongate array of orifices. An ink-receiving opening may extend along the side of the array of orifices, the curtain of air being directed across the array of orifices towards the opening. The opening may be defined by a gap between a deflector on the side of the opening remote from the array of orifices and an edge of a surface of the printhead in which the orifices are formed.

Preferably, an edge of the deflector which defines a first side of the gap is set back relative to the surface of the printhead in which the orifices are formed such that the said deflector edge is further away from the space within which substrates to be printed are presented than the said edge of the surface of the printhead which defines a second side of the gap. The set back of the deflector edge may be from 0.1 mm to 3 mm, for example 1 mm.

The deflector preferably defines a deflector surface extending from the deflector edge which defines the first side of the gap, the deflector surface being inclined to the curtain of air so as to deflect the curtain of air towards the said space within which substrates to be printed are presented. The deflector surface may be inclined at an angle of from 10° to 35°, for example 20°, to the direction in which the air curtain flows across the printhead, the angle of inclination being measured between the deflector surface and a line extending from the said edge in the direction of flow. The deflector surface preferably extends from the said deflector edge to a downstream edge on the side of the deflector edge remote from the array of orifices, a further surface of the apparatus extending from the downstream edge of the deflector in a direction away from the said space within which substrates to be printed are presented. The further surface is preferably inclined to the deflector surface at an inclined angle of from 70 to 155°, e.g. 110°.

Preferably an ink-receiving channel is defined behind the deflector, the ink-receiving channel opening into the gap and extending to a lower edge of the deflector. An ink collector may be located beneath a bottom end of the ink-receiving channel. The bottom end of the channel may be positioned to deliver ink to a formation on which ink will accumulate and which is in contact with or closely spaced from a surface defined by the collector. A manually adjustable screw may be mounted on the collector and adjustable in position relative to the formation such that irk on the formation can flow onto the screw and via the screw into the collector. Preferably, the collector comprises an overflow, means for detecting ink flowing through the overflow, and means for signalling a fault if overflowing ink is detected. The detecting means preferably comprises an emitter and a detector at least one of which is positioned to be at least partially covered by overflowing ink, and means for signalling a fault if an output of the detector indicates an overflow of ink. The emitter and detector may be arranged to project from a support surface which is located below the printhead and which is open to the said space within which substrates to be printed are presented, the emitter and detector being connected to a sensing circuit sensitive both to the presence of overflowing ink and to the presence of an object in front of the printhead which reflects emissions from the emitter to the detector. The emitter and detector may be angled towards each other and angled upwards. The ink-receiving opening may have a width of from 0.5 mm to 2 mm, for example 1 mm.

The air curtain may be generated from an elongate slot extending along the said one side of the array of orifices by pumping air through the slot towards the orifices. The slot may be defined between a body adjacent the printhead and an edge of a plate secured to the body, an air inlet communicating with a space defined between the body and the plate. The slot may have a width of from 0.1 mm to 0.3 mm, for example 0.2 mm. Air may be delivered to the slot at a pressure of from 100,000 to 600,000 Pa (1 to 6 bar) above atmospheric pressure, for example 300,000 Pa (3 bar).

Preferably, the pressure pulse applied to the irk has a duration from initiation of the leading edge to initiation of the trailing edge of less than 1 second, e.g. less than 300 ms, or less than 100 ms, or within the range of 10 to 50 ms.

The pressure may be applied through a valve which is switchable between a first condition in which a source of compressed air is connected to an ink supply arrangement, and a second condition in which the ink supply arrangement is connected to an exhaust conduit which communicates with the atmosphere via an airflow restrictor. Preferably the airflow restrictor is manually adjustable to enable control of the slope of the trailing edge of the pressure pulse. The pressure pulse may be applied after a predetermined number of printing operations have been performed by projecting ink from the orifices, for example after each printing operation.

The volume of ink delivered to the reservoir may be controlled in response to an ink demand initiated by detection of an ink level in any one reservoir section below the predetermined level, the ink supply control means being operative to deliver a predetermined volume of ink in response to an ink demand, to suspend ink delivery for a predetermined period, and to deliver further ink if an ink demand is indicated after the end of the predetermined period. The reservoir sections may communicate with a single compartment to which compressed air is delivered via a single air inlet to pressurise the ink in the reservoir sections, a baffle being positioned over the air inlet within the compartment to distribute incoming air evenly over all the reservoir sections. The reservoir sections are preferably defined within a common body partitioned to divide the interior of the body into the reservoir sections, each partition defining an edge over which ink can overflow from a reservoir section on one side of the partition to a reservoir section on the other side of the partition.

Preferably each reservoir section has housed within it a float which supports a magnet, displacement of the float by a changing ink level causing displacement of the magnet relative to a magnetic field sensor supported in a wall of the reservoir section, the magnetic field sensor providing an output indicating a demand for ink if the magnet assumes a predetermined position relative to the magnetic field sensor.

The magnetic field sensor may be a Hall effect device. The float and magnet may be supported on an arm pivotally mounted on the reservoir section wall, or the float and magnet may be supported on an arm pivotally mounted on a lid of the reservoir.

Embodiments of the present invention will now be described, by way of example, with reference to the accompanying drawings, in which.

Figure 1:
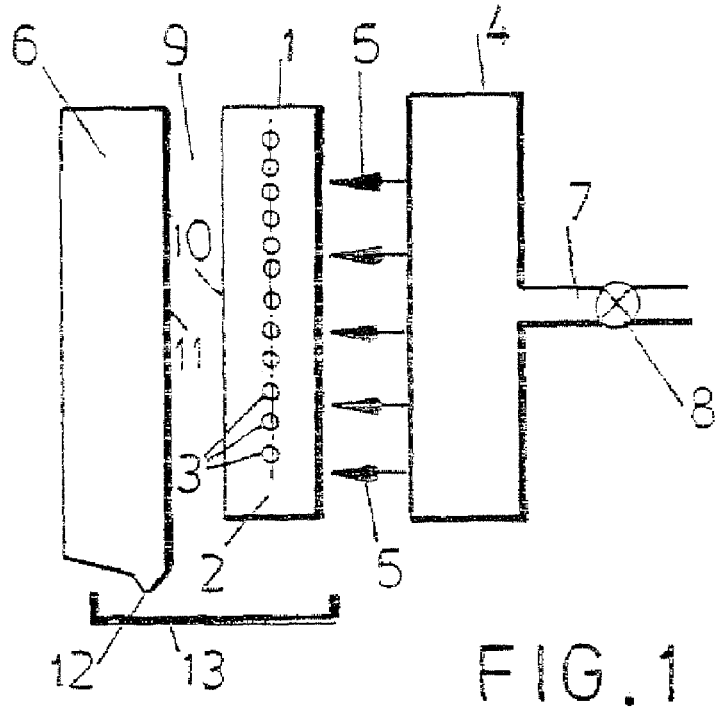
FIG. 1 is a schematic front view of an inkjet printer leaning apparatus in accordance with the present invention.
Figure 2:
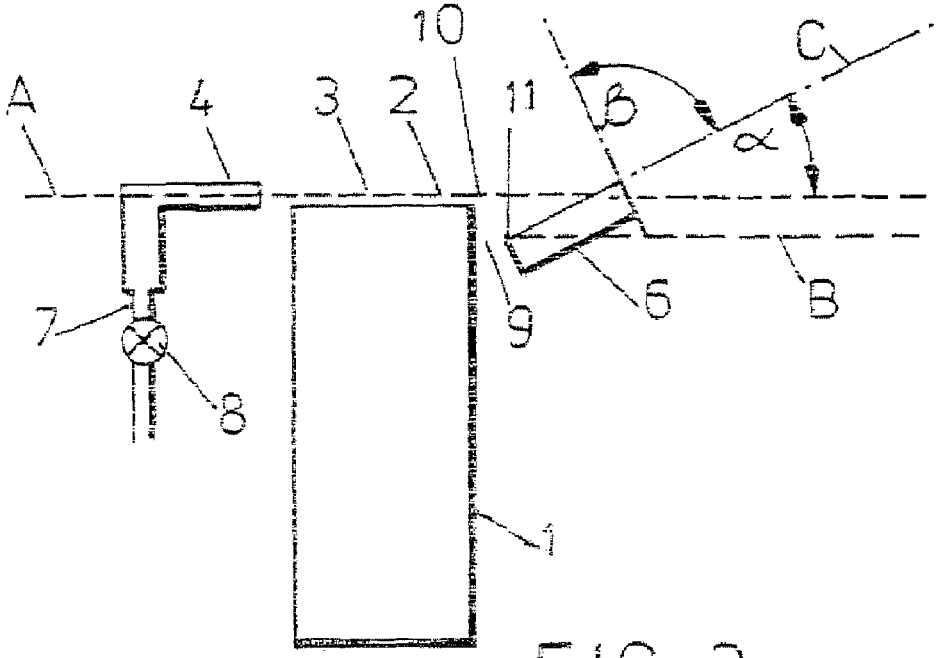
FIG. 2 is a schematic view from above of the apparatus shown in FIG. 1.
Figure 3:
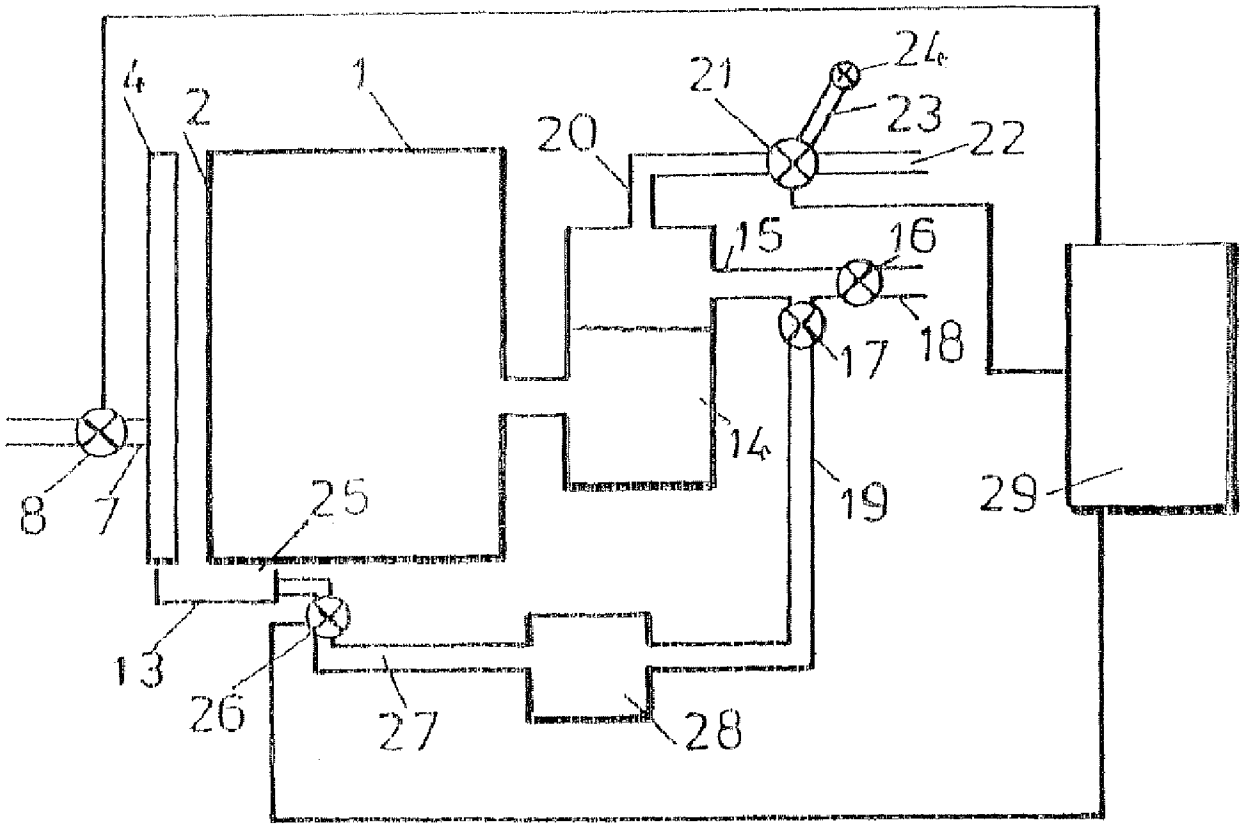
FIG. 3 is a schematic representation of components associated with the printhead cleaning apparatus illustrated in FIGS. 1 and 2.
Figure 4:
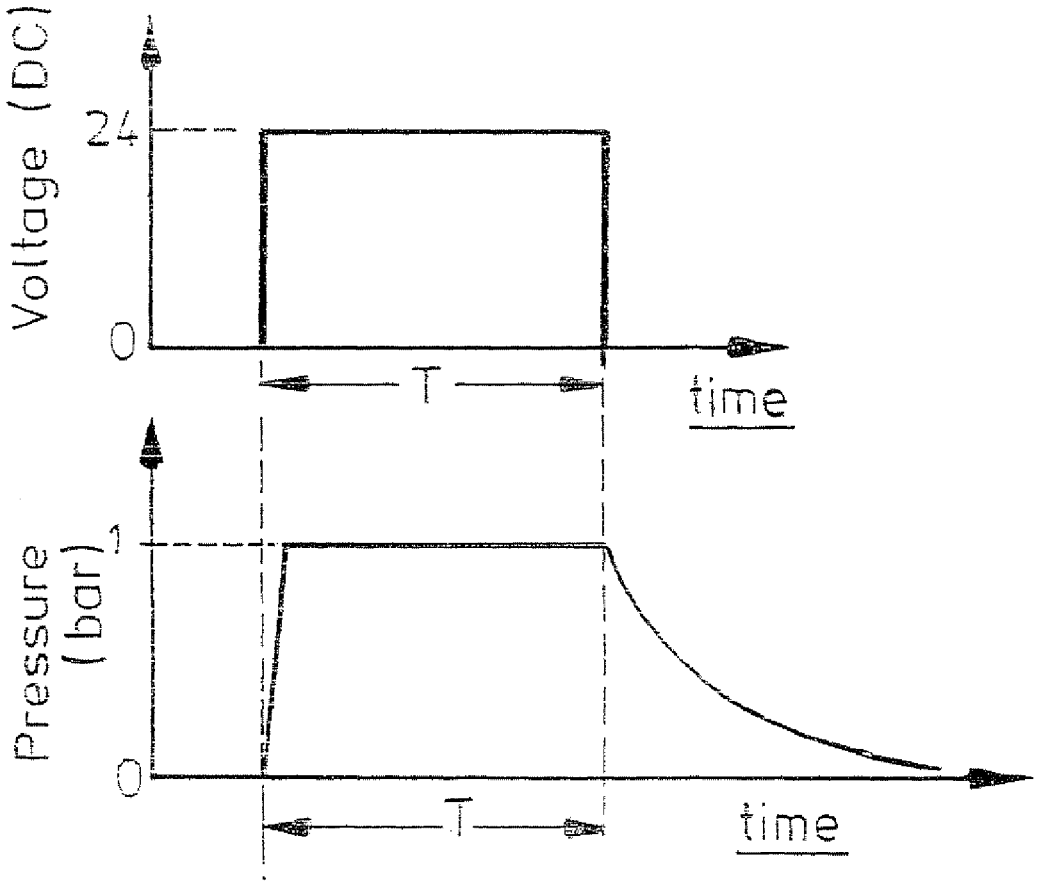
Figure 4A:
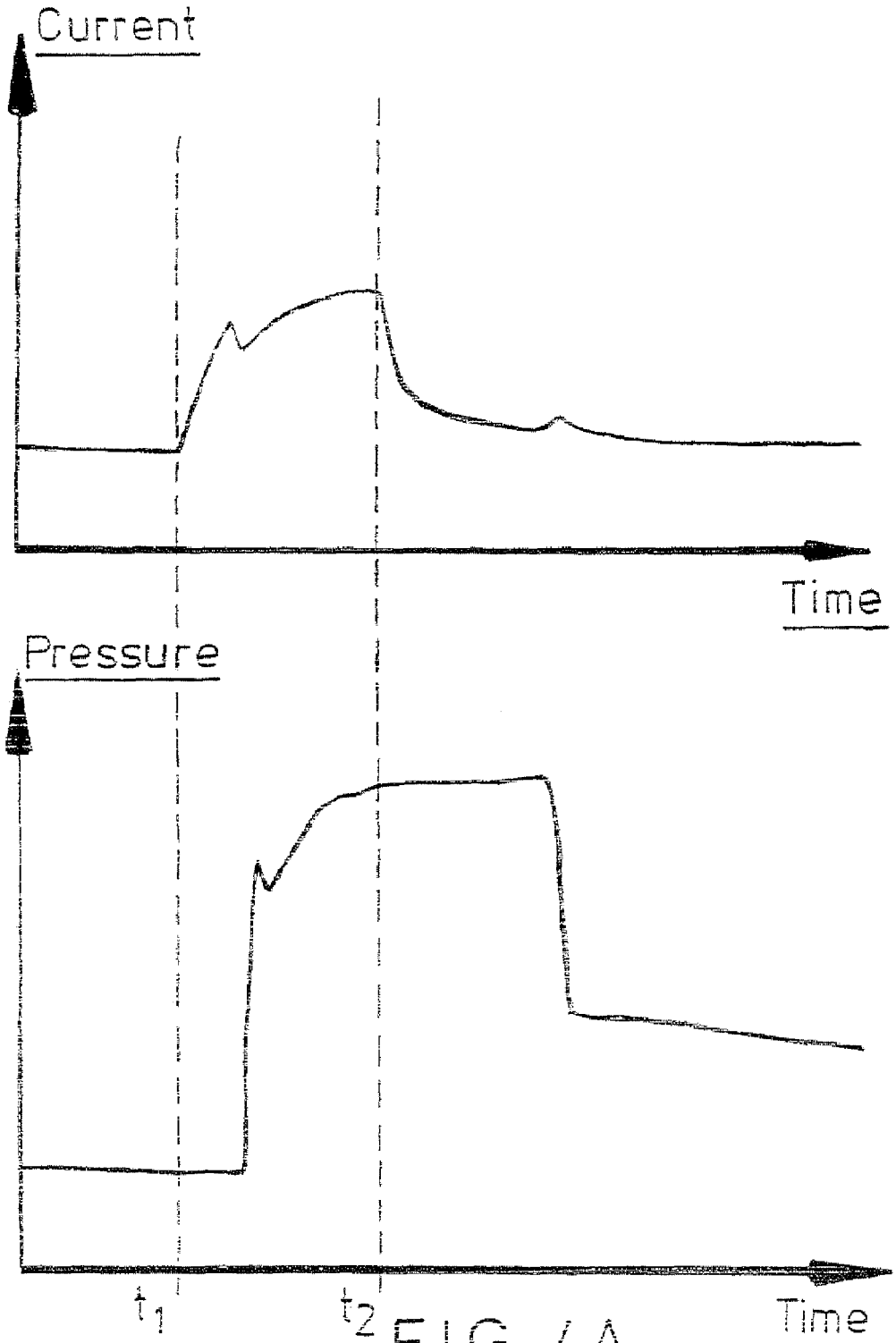
Figure 5:
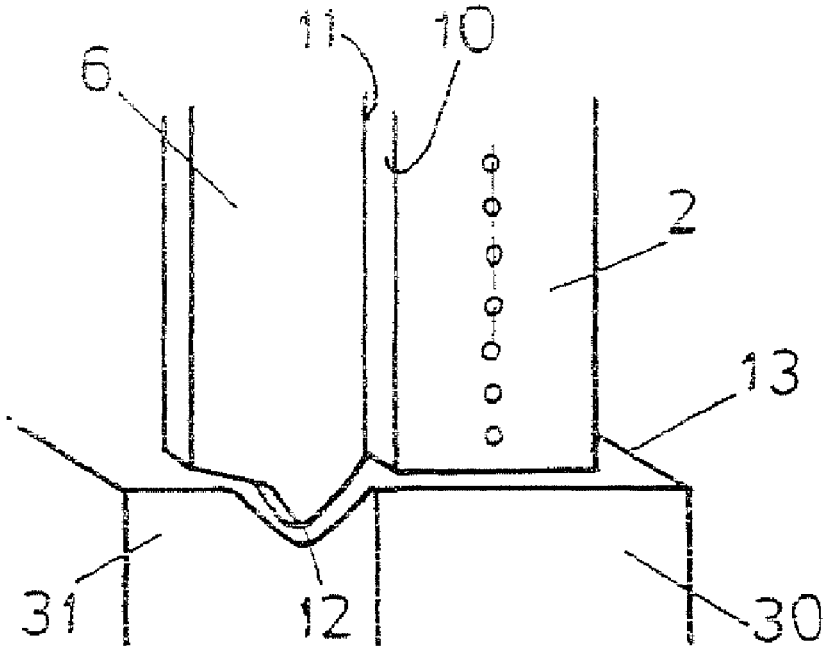
Figure 6:
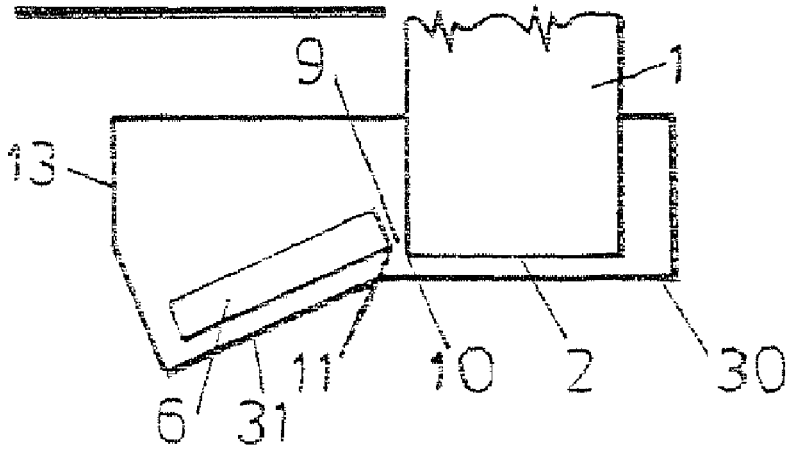
Figure 11:
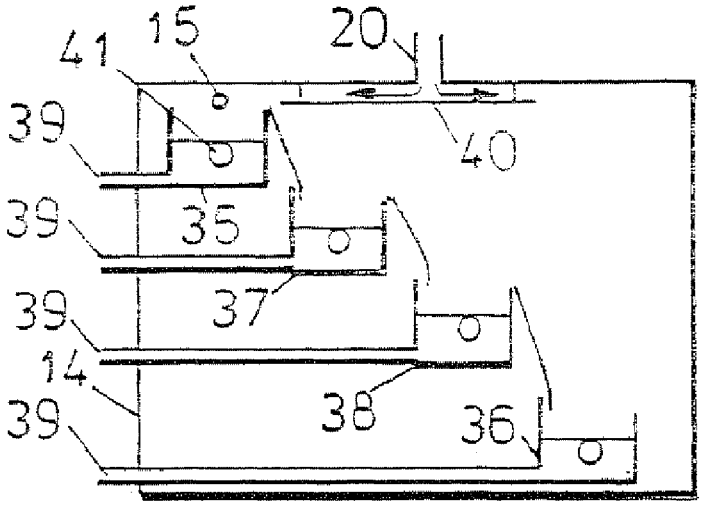
Figure 12:
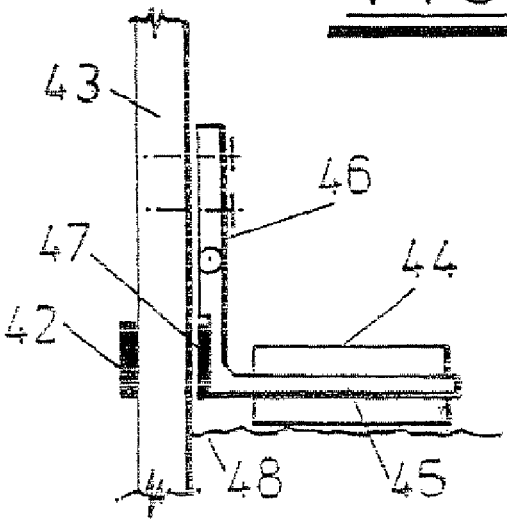
Figure 13:
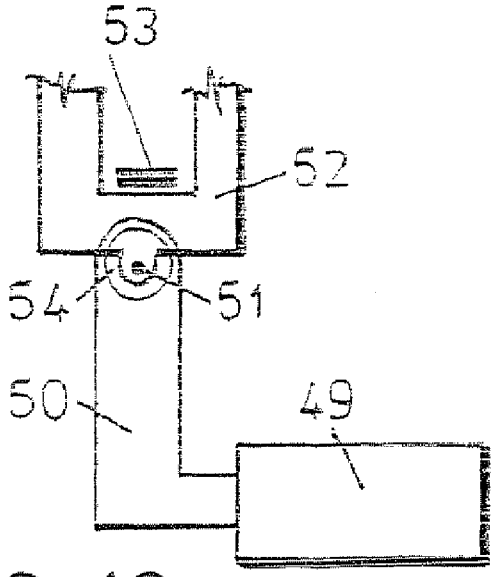
Figure 14:
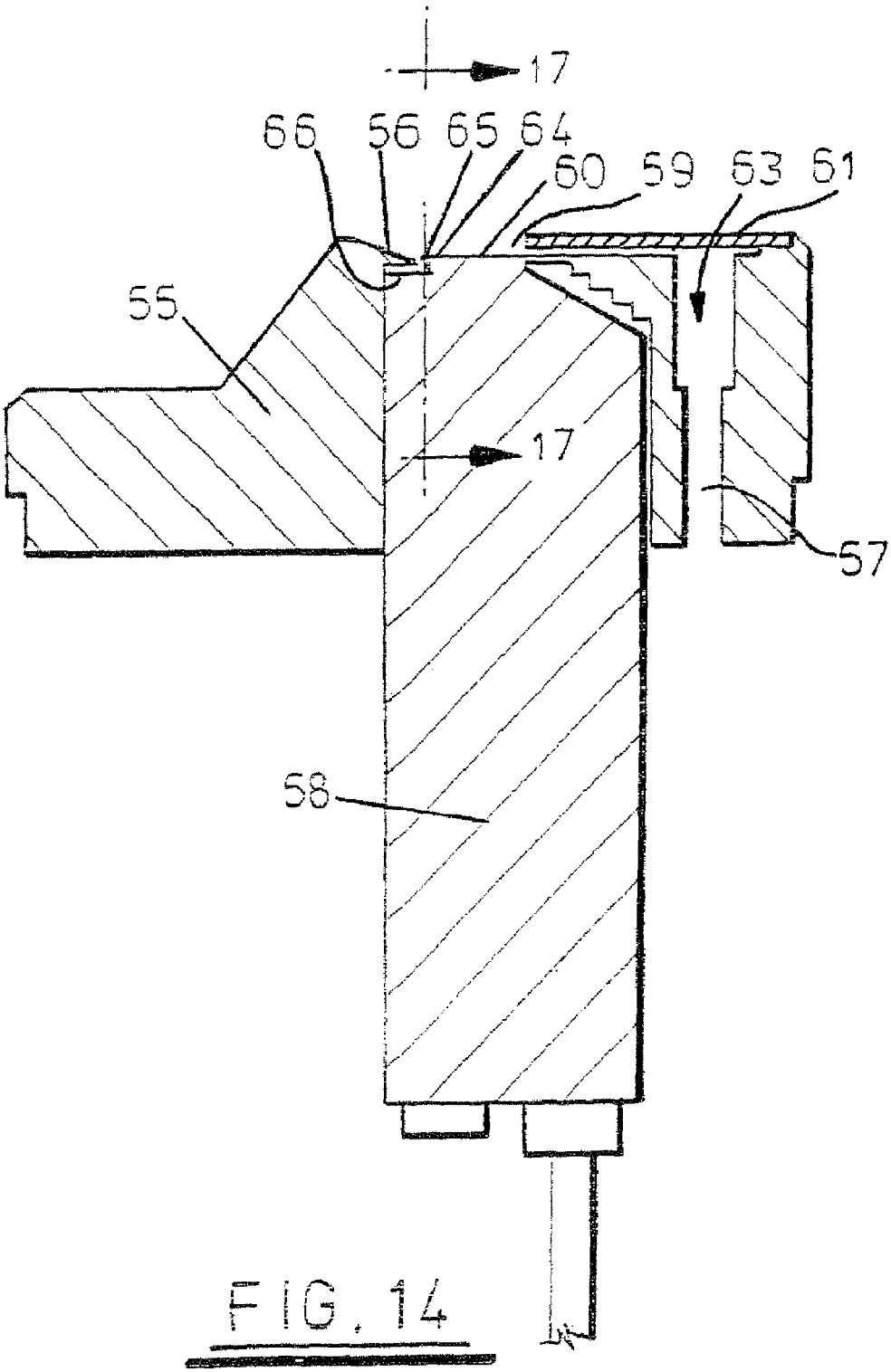
Figure 15:
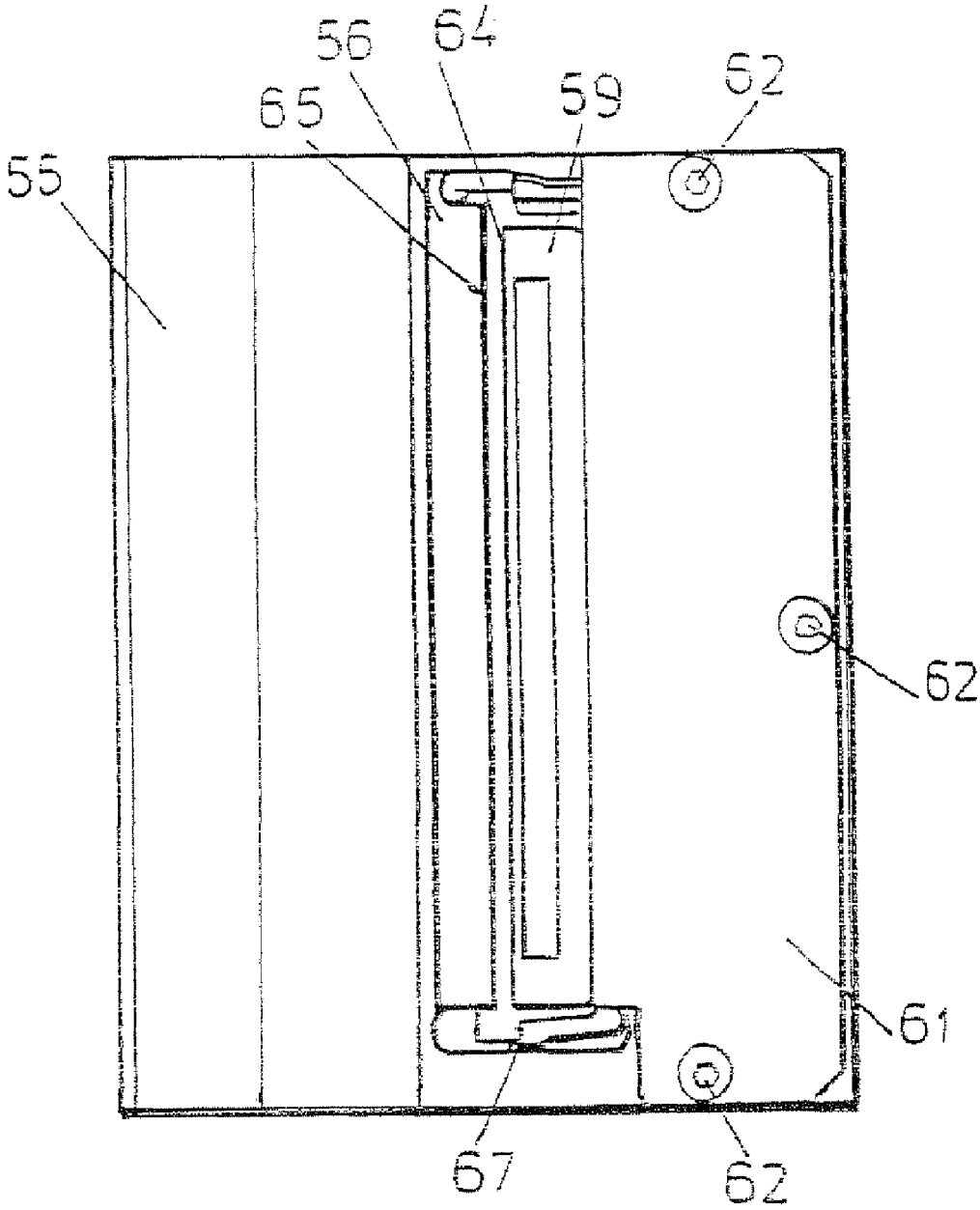
Figure 16:
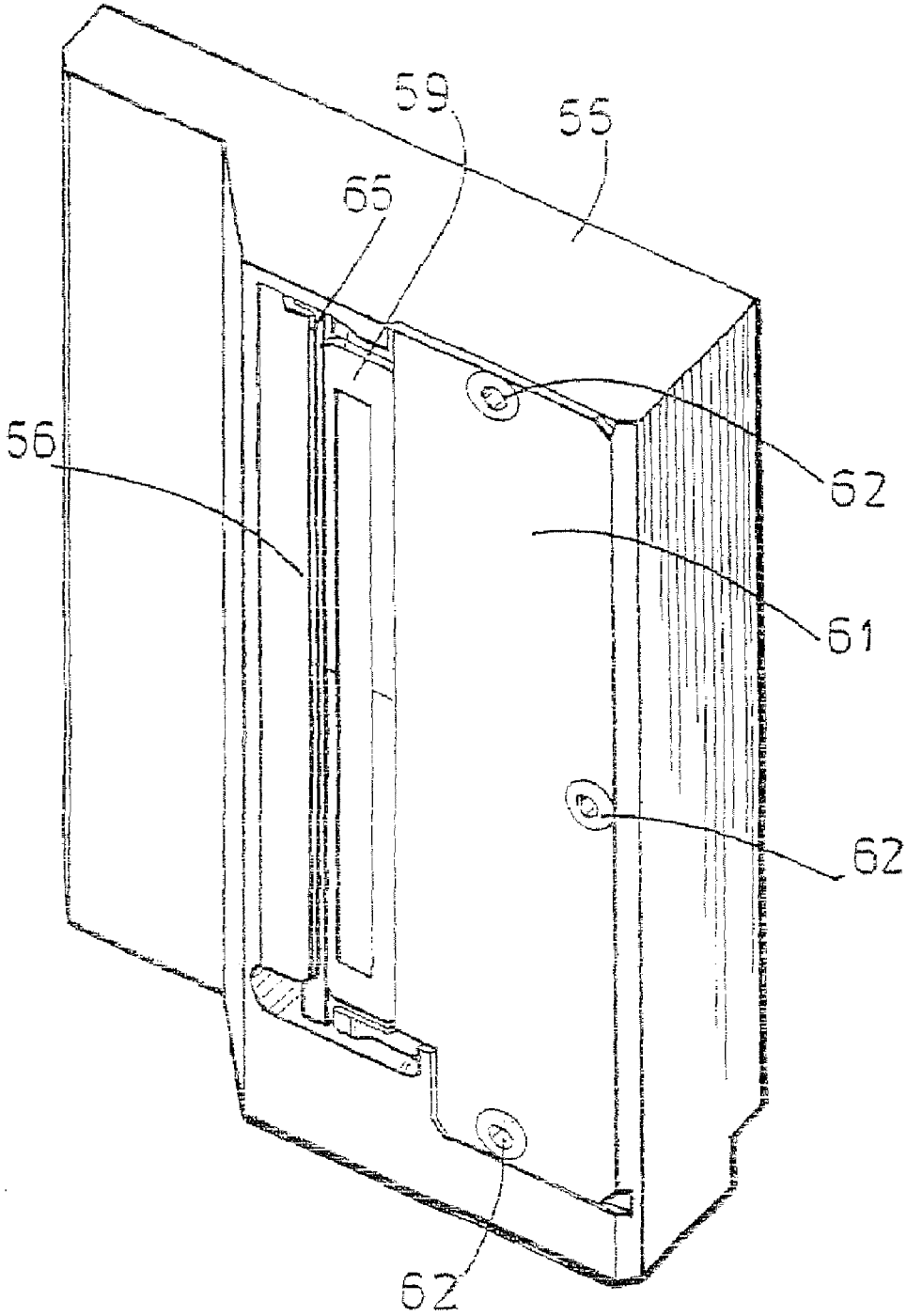
Figure 17:
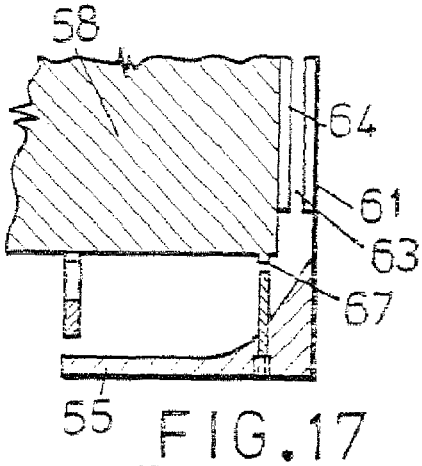
Figure 18:
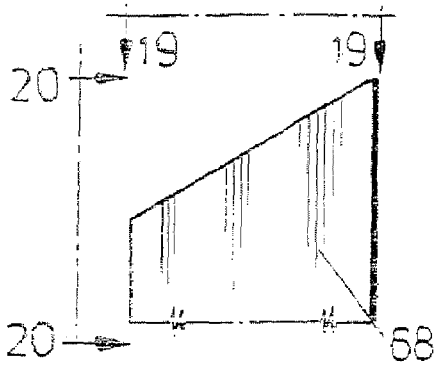
Figure 19:
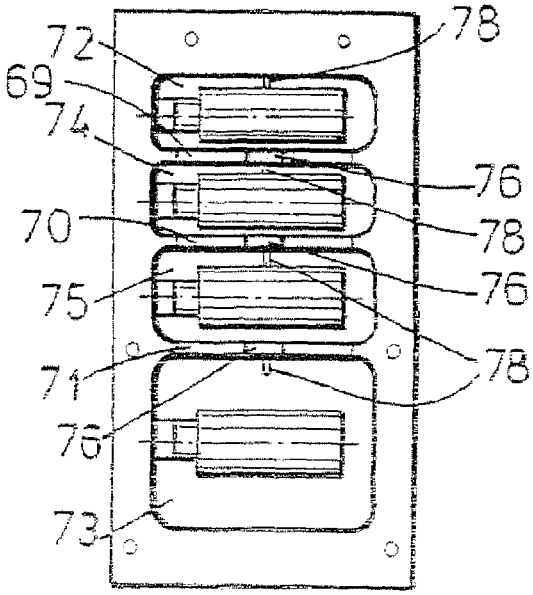
Figure 20:
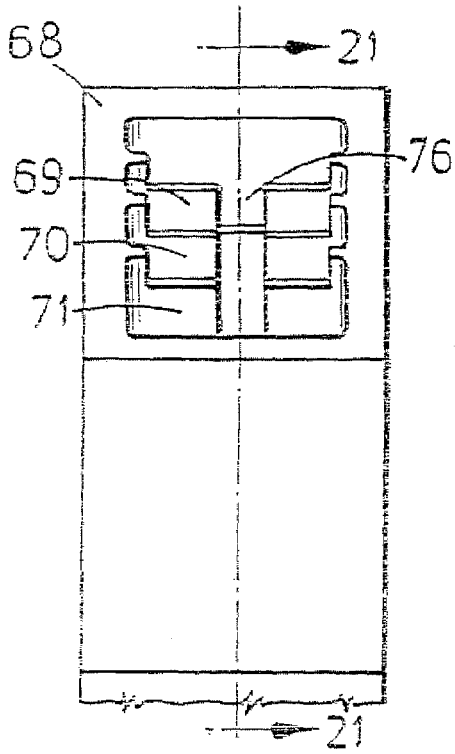
Figure 21:
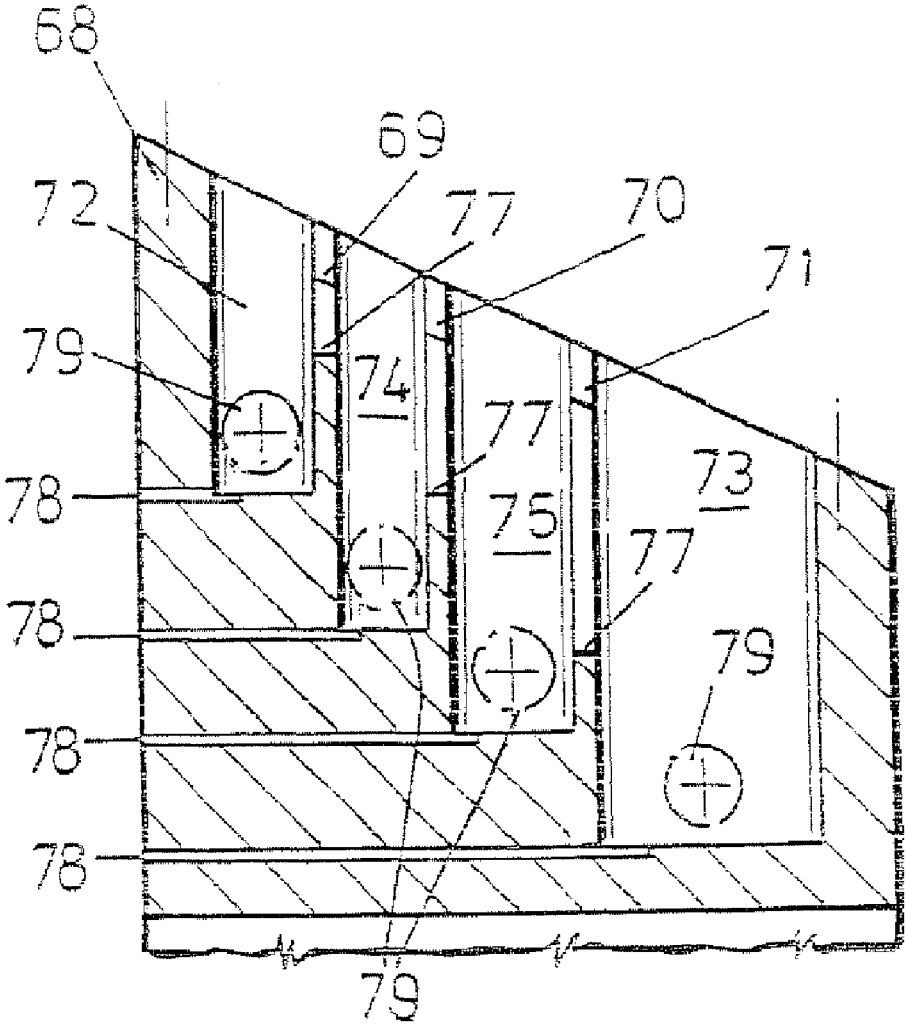

FIGS. 4 and 4*a* illustrate the shape of a pressure pulse applied to ink in a reservoir incorporated in the arrangement illustrated in FIG. 3;

FIG. 5 is a schematic perspective front view of lower portions of the apparatus illustrated in FIGS. 1 and 2;

FIG. 6 is a view from above of components shown in FIG. 5;

FIGS. 7, 8, 9 and 10 are schematic views of a waste ink collector and detector assembly incorporated in the apparatus schematically illustrated in FIGS. 1 and 2;

FIG. 11 is a schematic illustration of an alternative ink reservoir to that shown in FIG. 3;

FIGS. 12 and 13 are schematic views of two alternative ink level sensing arrangements which may be incorporated in the reservoir arrangement shown in FIG. 11;

FIGS. 14, 15, 16 and 17 illustrate in greater detail an embodiment of the invention having the general features of the arrangement illustrated in FIGS. 1 and 2, FIG. 14 being a horizontal section through the printhead assembly illustrated in front view in FIG. 15 and perspective view in FIG. 16 and FIG. 17 showing a part-section, on the line 17-17 of FIG. 14; and FIGS. 18, 19, 20 and 21 illustrate a practical embodiment of a reservoir arrangement of the general type illustrated in FIG. 11, FIGS. 19 and 20 being views on the lines 19-19 and 20-20 of FIG. 18 and FIG. 21 being a section or the lines 21-21 of FIG. 20.

Referring to FIGS. 1 to 3, a printing apparatus according to the invention is schematically illustrated which comprises a printhead 1 having a front surface 2 in which a linear array of orifices 3 is formed, an air supply device 4 for generating a curtain of air (represented by arrows 5) which sweeps across the surface 2, and a deflector plate 6 located downstream of the surface 2. In use, the surface 2 faces a path along which substrates to be printed (not shown) are transported. Ink is projected from the orifices 3 onto such substrates. The printhead 1 may be of any conventional type. The front surface 2 of such printheads which defines the orifices 3 is generally referred to as an "orifice plate" and that term will be used hereinafter for the surface 2 in which the orifices 3 fare formed. In the described embodiment, the orifice plate 2 is planar and extends vertically, although it will be appreciated that in other embodiments of the invention the orifice plate 2 need not be planar and may be mounted so as to be inclined to the vertical, at any angle between 0° and 90°.

The air supply device 4 is supplied with compressed air via a conduit 7, the supply of air being controlled by a solenoid-actuated valve. When the valve 8 is open, the air curtain 5 is established so as to sweep any ink or contaminants on the orifice plate 2 towards a gap 9 defined between a downstream edge 10 of the orifice plate and an upstream edge 11 of the deflector plate 6. Ink swept from the orifice plate 2 is directed by the flow of air into the gap 9 and thereafter flows downwards under gravity to drip from a drip point 12 on the lower edge of the deflector plate 6. Such ink is collected in a collector 13.

As shown in FIG. 2, the air supply device 4 has a rearwardly extending (relative to the orifice plate 2) portion which is coupled to the air supply conduit 7 and an open ended portion arranged so as to direct the curtain of air 5 in a plane indicated by line A which is parallel to the orifice plate 2. The open end of the air supply device 4 defines an elongate outlet of substantially rectangular cross section. The outlet may be for example 0.2 mm, wide. Such an arrangement efficiently channels a well-defined curtain of air across the orifice plate 9 towards the downstream edge 10 and the gap 9.

The upstream edge 11 of the deflector plate 6 is set back from the orifice plate surface 2, the edge 11 lying on a plane indicated by line B in FIG. 2, the plane indicated by line B being parallel to the plane indicated by line A. The spacing between plane B and the plane including the orifice plate surface 2 is less than 1 mm. The width of the gap 9 (that is the spacing between the edge 11 of the deflector plate 6 and a line through the edge 10 of the orifice plate 2 extending perpendicular to the line B) is between 0.5 mm and 1.5 mm, for example 1 mm.

The deflector plate 6 extends in a direction parallel to a plane indicated by line C, the plane C being inclined to the plane of the orifice plate 2 by an angle $\alpha$ which in the illustrated embodiment is approximately 20° but will generally be in the range of 10° to 35°. The deflector plate 6 has a width (the dimension in the direction away from the printhead parallel to the line C) of approximately 5 mm. The downstream edge of the plate 6 is cut back to define the angle $\beta$ shown in FIG. 2. That angle (which is equal to the included angle defined between the surfaces extending from the downstream edge of the plate 6) will typically be of the order 110° but will generally be in the range of 70° to 155°.

The downstream edge of the plate 6 is cut back in order to improve the flow of air over the orifice plate 2. When printing for example a cardboard box which defines a flat surface close to the printhead assembly, the presence of the box increases air flow resistance. If the downstream edge of the plate 6 was not cut back such that an extensive surface was defined extending parallel to the plane A (corresponding to the sum of the angles $\alpha$ and $\beta$ being equal to 180°), a small elongate gap would be defined between the printhead assembly and the box downstream of the plate 6. Such a gap would result in air flow resistance that could disrupt the flow of the air curtain across the orifice plate 2.

FIG. 3 illustrates the interconnection of the printhead 1 the air supply device 4 and the waste ink collector 13 to associated components. Ink is supplied to the printhead 1 from a reservoir 14. The reservoir 14 comprises a first inlet 15 connected via one-way check valves 16 and 17 (to ensure unidirectional flow of ink) to a conduit 18 leading from a main ink supply storage vessel (not shown) and to a conduit 19 which is coupled by an ink recycling mechanism to the collector 13. The reservoir 14 also has a second inlet 20 connected via a valve 21 to a compressed air supply conduit 22 and an air exhaust conduit 23 terminating in a restrictor valve 24 which may be manually adjusted to vary the rate at which air can be exhausted through the conduit 23. The valve is controllable to assure either an "open" condition in which conduits 20 and 22 are in communication, or a "closed" condition in which conduits 20 and 23 are in communication.

The conduit 19 is coupled to the ink collector 13 by a conduit 25 leading to a pump 26, a conduit 27 into which the pump 26 delivers ink from the collector 13, and a filtering unit 28 which ensures that only ink which is sufficiently clean for re-use is deliver to the reservoir 14.

The pressure of air supplied to the air supply device 4 will typically be of the order of 3 bar (300,000 Pa). The valve 8 will either be closed or fully open so as to deliver the supply pressure to the interior of the air supply device 4. The compressed air delivered to the valve 8 will be appropriately regulated to maintain the desired pressure and the supplied air will be appropriately cleaned and filtered. The same supply of air is used to deliver compressed air to conduit 22 connected to valve 21 but the pressure applied to the surface of the ink in the reservoir 14 may be limited as described with reference to FIGS. 4 and 5. In that in the described embodiment the pressure is limited to 1 bar above atmospheric pressure, but will be limited to a range of from 0.2 to 0.8 bar or 0.4 to 0.6 bar for example.

The valves 8 and 21 and the pump 26 are controlled by a controller 29. When a substrate is to be printed the valve 8 is closed and the valve 21 is closed. Thus no air flows across the orifice plate 2 and there is therefore no risk of projected jets of ink being deflected from their intended path. At a time when not printing, a purge procedure is executed in which initially the valve 8 is opened so as to establish a flow of air across the orifice plate 2, and then the valve 21 is opened to apply a positive pressure to the ink within the reservoir 14, causing ink to be discharged out of the orifices 3 onto the surface of the orifice plate 2. That ink is then displaced by the air flowing across the orifice plate and gathers in the gap 9 on the downstream side of the orifice plate. The flow of air across the orifice plate 2 is then cut off by closing the valve 8. The printer is then ready for the next printing cycle. It may take sometime for ink to run down into the collector 13 but as it is retained in the cap 9 on the downstream side of the orifice plate 2 this does not impede the normal operation of the printer. The pump 26 is used to periodically transfer ink from the collector 13 to the reservoir 14. For example, the pump 26 may be turned on for a predetermined period after each purge procedure.

The time which elapses between initiation of a purge procedure and delivery of substantially all of the purged ink to the gap 9 is the sum of the duration of the period within which ink is purged from the orifices in the orifice plate 2 and the period of time taken for the purged ink to be swept into the gap 9. Minimisation of the period for which positive pressure is applied to ink in the reservoir is therefore desirable and accordingly as illustrated in FIGS. 4 and 4A in the described embodiment of the invention a short duration pulse of positive pressure is applied to the ink in the reservoir 14. FIG. 4 represents an idealised performance which could be achieved using extremely fast-acting components, whereas FIG. 4A represents the performance achieved with readily available standard components.

The upper half of FIG. 4 shows a voltage versus time diagram representing a control voltage applied to the valve 21, a zero voltage corresponding to closure of the valve 2 and 24 volts corresponding to full opening of the valve 21. A control voltage pulse of duration T having a steeply rising leading edge and a steeply falling trailing edge is applied to the valve 21. The valve 21 is arranged however when "closed" to connect the exhaust conduit 23 to the reservoir inlet 20. As a result when the valve 21 is closed air can bleed out of the reservoir 14 at a rate determined by the setting of the restrictor valve 24.

The lower half of FIG. 4 shows the variation of the positive pressure applied to the reservoir 14 with time. It will be seen that the pressure rises rapidly as soon as the valve 21 is opened but falls relatively slowly when the valve 21 is closed, the rate of fall being determined by the setting of the restrictor valve 24. Thus the pressure pulse applied to ink within the reservoir 14 has a relatively rapidly rising leading edge and a relatively slowly falling trailing edge. It is desirable for the leading edge to be relatively rapidly rising as this serves to minimise the duration of the purge cycle. It is desirable to have the slowly falling trailing edge as, if the trailing edge is steep, tie resultant sudden removal of the force causing irk to be purged out of the orifices can cause individual jets to be de-primed or can cause air to be sucked into the printhead which could disrupt printhead operation. A jet will be de-primed if it is not full of ink with the ink forming a meniscus at the jet orifice. Generally the period T will not be more than 1 second and much shorter periods of time can be used with success. Preferably T will be less than 100 ms and good results have been achieved with pressure pulses generated using a voltage pulse of duration T between 10 ms and 30 ms.

The performance represented in FIG. 4 is idealised in that the pressure starts to respond substantially instantaneously to the control pulse. In practice, such a performance cannot be achieved using readily available and appropriately priced components. FIG. 4A illustrates the performance achieved in one practical embodiment of the invention in which the valve 21 was obtained from MAC Valve Europe, part number 34AA BA GD FA-1BA with a specified on time of 3.4 ms (time taken to respond to a valve open control input) and an off time of 15 ms (time taken to respond to a valve close control input). The restrictor 24 was obtained from SMC UK, part number A51001F-04 and had a simple manually adjustable screw arrangement. The upper part of FIG. 4A represents current drawn by the valve, and the lower part represents the pressure in the inlet 20.

It will be noted that there is a delay of several milliseconds after the valve 21 begins to draw current (time $t_1$) before the valve 21 starts to open, but thereafter the valve opens quickly and the pressure in the reservoir inlet 20 rises rapidly. The rate of rise of the pressure tails off as the pressure rises towards the supply pressure in conduit 22. Given this tail off in the rate of pressure rise, and the short duration of the pressure pulse, the maximum pressure applied to the ink reservoir may be substantially below the supply pressure, e.g. only 0.5 bar with a supply pressure of 1 bar. Similarly, there is a delay after the current to valve 21 begins to fall (time $t_2$) before the valve 21 starts to close. Once the valve 21 begins to close, there is an initial rapid fall in the pressure within inlet 20, but thereafter there is a relatively slow fall off in the pressure within inlet 20 as air flows out through the restrictor 24. The initial rapid fall in pressure reduces the period for which ink is being purged, whereas the subsequent slow fall in pressure avoids problems with jet de-priming.

In the case illustrated in FIG. 4A, the control input to the valve 21 has a duration ($t_2$-$t_1$) of 20 ms. The resultant pressure pulse has a duration of about 30 ms until the initial rapid fall in pressure, the pressure then falling father over a period of several tens of milliseconds. A pressure pulse duration of 30 ms has produced good results, but acceptable results have been achieved with the particular printhead used using pressure pulse durations in the range 10 to 50 ms and larger pressure pulses will be appropriate with different printheads and associated equipment.

Although a pressure pulse of only 30 ms duration is preferred, even with such a short duration pulse ink may continue to be purged from the printhead orifices for a substantial period dependent upon the hydrodynamic characteristics of the overall assembly. For example, ink may still be purged more than 100 ms after termination of the pressure pulse. The air curtain which cleans the orifice plate should be maintained for a sufficient duration to ensure that all purged ink has been displaced off the orifice plate, for example for a duration of 200 ms or 300 ms. The more efficient the cleaning the better, as the risk of dust sticking to the orifice plate is reduced. In a very dirty environment, a decision might be taken to maintain the air curtain except during printing, although there will be a trade-off between cleaning efficiency and the cost of compressed air supplying the air curtain.

FIGS. 5 and 6 show in greater detail one possible arrangement of the collector 13 which collects ink dripping from the drip point 12 at the bottom of the deflector plate 6. FIG. 5 is a schematic perspective view from in front of the collector 13, whereas FIG. 6 is a view from above showing that the collector 13 has a first front wall portion 30 extending parallel to the orifice plate surface 2 and a second front wall portion 31 extending parallel to the outer face of the deflector plate 6. The collector 13 extends beyond the edges of the printhead and the deflector plate such that the horizontal spacing between the top edge of the front wall portion 30 and the orifice plate 2 is in the range of 0.5 to 2.5 mm and preferably is approximately 1 mm. The same spacing is maintained between the upper edge of the second front wall portion 31 and the plane of the front surface of the deflector plate 6. The upper edge of the front wall portion 31 is contoured so as to follow the lower edge of the drip point 12 as shown in FIG. 12. Thus the upper edge of the first and second front wall portions 30 and 31 is in close proximity to the drip point 12 and the lower edge of the orifice plate 2. This facilitates the rapid transfer of ink by capillary action into the collector 13.

The collector 13 is shaped so as to cause collected ink to run backwards away from the front wall portions 30 and 31 and into a cup-shaped sump from where it is sucked away by the pump 26 (FIG. 3). Ink may be recycled by pumping it through the filtering unit 28 directly into the reservoir which is close-coupled to the printhead as shown in FIG. 3, or alternatively to a main supply vessel which may be positioned at a relatively remote location and from which ink is delivered to the reservoir 14 so as to maintain tie ink level within the reservoir 14 within acceptable limits.

The collector 13 may be modified to support components which enable detection of a problem resulting in overflow of the collector 13 and detection of products moving in close proximity to the orifice plate 2. As shown in FIGS. 7 to 10, an emitter 32 and a detector 33 are mounted so as to protrude from the first front wall portion 30 of the collector 13, that is the portion immediately below the orifice plate 2. The emitter and detector are mounted so as to protrude by a small distance for example 2 mm from the wall 30. The emitter 32 and detector 33 are mounted at an angle $\gamma$ (typically approximately 70°) to the plane of the front portion 30 of the collector 13 so as to be angled slightly towards one another. The emitter and detector are also mounted as an angle $\delta$ of approximately 5° to the horizontal. It is preferred to angle the emitter and detector upwards in this way so as to reduce the risk of unwanted signals being detected as a result of for example reflection from a conveyor or the like on which substrates to be printed (e.g. boxes) are transported past the orifice plate.

The emitter 32 and detector 33 are connected to the controller 29 of FIG. 3 Signals received by the detector 33 include a component that represents an amount of light emitted by the emitter 32 and transmitted directly to the detector 33. Such direct communication between an emitter and detector is generally referred to as "cross talk". The signal received by the detector may also include a further component which represents light that has been emitted by the emitter 32 and reflected back to the detector from an object placed in front of the emitter/detector pair. This second component of the detected signal may be processed by the controller 29 to provide a signal representing the presence of an object in front of the printhead which in normal circumstances will be an object defining a surface on which information is to be printed. By appropriate setting of the emitter/detector circuitry the arrangement may be set up to limit the range of distances away from the sensors that a "product" can be sensed. In some printing processes it is advantageous to ignore products that are beyond a certain maximum acceptable distance away from the printhead.

Figure 9:
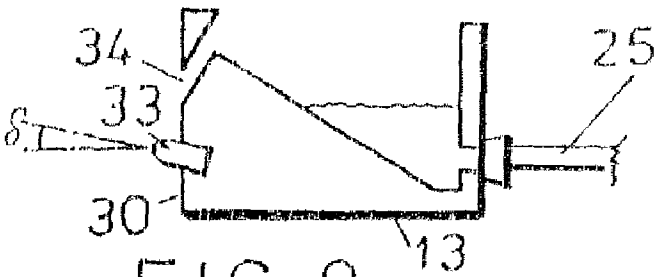
Figure 10:
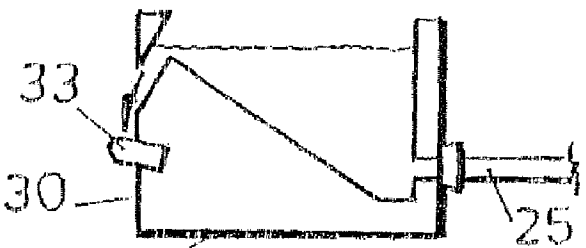
Figure 7:
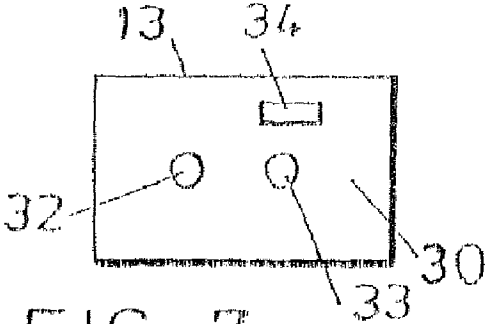
Figure 8:
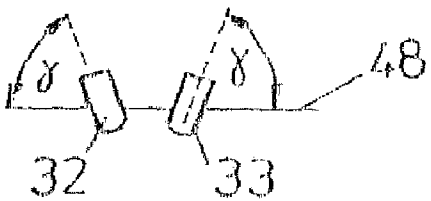

Thus the emitter/detector pair as shown in FIGS. 7 to 10 can be used to detect the presence of a box or the like on which a pattern is to be printed. In addition however the emitter/detector pair can be used to detect overflow of collected ink. To achieve this, an overflow outlet 34 is detailed in the front wall portion 30 immediately above the detector 33. In normal circumstances, ink levels within the collector 13 will be such that ink cannot flow through the overflow outlet 34. Such circumstances are represented in FIG. 9. If however as a result of failure collected ink is not discharged from the collector 13 via the conduit 25, the ink level will rise such that ink will flow through the outlet 34 onto the detector 33. Overflowing ink runs down, under gravity, the front face 30 of the collector 13 and impinges on the top of the detector 33. The ink then flows around the circumference of the detector, thus blocking some of the sidewall of the detector. This results in a change in the "cross talk" component of the signal output by the detector and by appropriate processing of this signal the controller 29 can detect the overflow of ink. As a result the controller 29 can enunciate or otherwise communicate a warning of fault condition.

In the embodiment of the invention illustrated in FIG. 3, the reservoir 14 from which ink is delivered to the printhead 1 is shown as a single vessel. Such an arrangement is acceptable if the vertical extent of the array of orifices 3 in the orifice plate 2 is limited to for example 10 mm. If a greater vertical extent of the array of orifices is required, and arrays having a vertical height of 70 mm are well known, it is desirable to divide the orifice plate into vertically spaced sections with each section being supplied from a separate reservoir section, the reservoir section being positioned at different heights such that the relative virtual positions of each reservoir section/orifice plate section pair are substantially the same. Thus the orifice plate receives ink from multiple ink supply conduits, each conduit sucking one reservoir section to a respective one orifice plate section. This avoids hydrostatic pressure presenting too great a pressure difference as between orifices at the top of the array and orifices at the bottom of the array. Such hydrostatic pressures can result either in the uppermost orifices not being correctly primed or ink being discharged unintentionally from orifices adjacent the bottom of the array. FIG. 11 illustrates a reservoir 14 divided into four vertically spaced sections with each section feeding a respective group of orifices.

Referring to FIG. 11, the schematically illustrated reservoir 14 comprises an uppermost reservoir section 35, a lowermost reservoir section 36, an upper intermediate reservoir section 37 and a lower intermediate reservoir section 38. Ink can be delivered to the uppermost section 35 from the first reservoir inlet 15 (see FIG. 3). The uppermost reservoir section 35 has an overflow such that if that section is overfilled ink will overflow into the upper intermediate section 37. Similarly section 37 overflows into section 38 and section 38 overflows into section 36. In normal circumstances, the lowermost section 36 will never overflow. Each of the sections is connected to a respective outlet 39 which in turn is connected to a respective group of the jets of the associated printhead.

The vertical disposition of each reservoir section relative to the respective group of orifices is substantially the same so that the same pressure differentials will apply in the case of each of the four groups of orifices making up the single array of orifices in the printhead. Normally the interior of a compartment in which each of the reservoir sections 36 to 38 is housed will be held at normal atmospheric pressure. During a purge procedure however that pressure will be increased by approximately 1 bar as a result of compressed air being pumped into the reservoir via inlet 20. A baffle plate 40 is arranged over the inlet 20 so as to distribute incoming compressed air evenly across all of the reservoir sections.

Each reservoir section is provided with a sensor arrangement schematically represented in FIG. 11 by circles 41. Each sensor provides an output to the controller 29 (FIG. 3) representative of the level of ink within the respective reservoir section. If any one sensor indicates that the ink level within the respective reservoir section has fallen below a predetermined lower limit, ink is pumped into the reservoir so as to be delivered initially into the uppermost reservoir section 41. If it is that section which has been indicated as empty, ink is supplied until the level sensor of that section indicates that the level has risen to a predetermined upper limit. In such circumstances ink does not overflow from the upper reservoir section 35. If however a level sensor associated with one of the other three reservoir sections indicates that the respective section needs to be refilled, ink is still delivered to the uppermost section 35 but cascades down the series of reservoir sections until it reaches the reservoir which requires refilling. As soon as that reservoir has been refilled to a predetermined level the delivery of ink to the uppermost section is terminated.

The volumes of ink which are discharged from and delivered to the various reservoir sections are relatively small. As a result, if for example the lowermost section 36 required refilling and ink was pumped continuously into the uppermost section until the lowermost section 36 was full, it could be that so much ink would have been delivered to the uppermost section by the time that the lowermost section 36 was full that the lowermost section could overflow once all the ink already delivered had overflowed down to the lowermost section. To avoid this happening, ink can be delivered to the uppermost section 35 in a controlled manner. For example, whenever a demand for ink is signaled by one of the sensors 41, a controlled volume of ink could be delivered, the volume being limited to ensure that overflow cannot occur. If after a predetermined delay a demand for ink is still indicated the same volume could again be delivered, the cycle being repeated until such time as the signal indicating a demand for ink has disappeared. For example ink could be pumped into the uppermost reservoir section for a set period and then the delivery of ink could be arrested for a second set period. Such a procedure avoids the risk of overflow.

FIG. 12 is a schematic illustration of an ink level sensor which could be used to sense the level of ink in each of the reservoir sections 35 to 38. A Hall effect magnetic sensor 42 is mounted on the outside surface of a wall 43 of the ink reservoir. Mounted within the reservoir is a float 44, the float 44 being supported on a lower arm 45 that is pivotally supported on an upper arm 46 secured to the inner wall of the reservoir. The pivotal lower arm 45 supports a magnet 47. The ink level when the reservoir is substantially empty is indicated by line 48. If the ink level rises the float moves up with the ink, causing the magnet 47 to swing away from the wall 43 and hence to move away from the Hall effect detector 42. The Hall effect detector 42 can be connected to a sensing circuit which signals that the reservoir is substantially empty as soon as the magnet 47 moves into close proximity to the wall 43. Thus the output of the Hall effect sensor 42 can be used to control the supply of ink to the reservoir.

Referring to FIG. 13, an alternative ink level sensor to that illustrated in FIG. 12 will be described. In the arrangement of FIG. 13, a float 49 is mounted on an arm 50 which is mounted to pivot about a pivot axis 51, the pivot axis being supported on a member 52 which forms part of the lid of the reservoir. A Hall effect sensor 53 is mounted on the lid member 52. The arm 50 supports a bipolar magnet 54 arranged such that rotation of the arm 50 about the pivot 51 substantially alters the magnetic field to which the Hall effect sensor 53 is exposed. Thus an output from the Hall effect sensor 53 can be used to control the delivery of ink to the reservoir in which the float 49 is positioned, the orientation of the float 49 in FIG. 13 corresponding to a reservoir empty condition.

Referring to FIGS. 14, 15, 16 and 17, constructional details of an embodiment of the invention operating as described with reference to FIGS. 1 to 3 are shown. A single piece cast and machined body 55 defines a deflector plate 56 corresponding to the deflector plate 6 of FIGS. 1 to 3 and an air inlet 57 which in use is connected to an air supply conduit corresponding to the air supply conduit 7 of FIGS. 1 to 3. A printhead body 58 is mounted on the body 55, the printhead body defining an orifice plate 59 corresponding to the orifice plate 2 of FIGS. 1 to 3. A linear array of orifices extends down the centre of the orifice plate 59 at the position indicated by numeral 60. A plate 61 is secured by screws 62 to the body 55, the plate 61 defining with the body a channel 63 which communicates with the air inlet 57 and from which a curtain of air is directed across the orifice plate 59 when the air inlet 57 is connected to a supply of compressed air. It will be noted that, as in the embodiment of FIG. 2, the surface facing substrates to be printed upon is cut back on the downstream side of the deflector plate. Whereas in FIG. 2, the cutback is from a sharp edge on the downstream side of the plate 6, in FIG. 14 the cutback is from a short surface extending parallel to the orifice plate 59 from the downstream edge of the deflector plate 56.

In use, when ink is purged from the orifices 60 and a curtain of air is directed across the orifice plate 59, that air pushes the purged ink to the downstream edge 64 of the orifice plate 59 and the ink flows through a gap defined between that downstream edge 64 and an upstream edge 65 of the deflection plate 56 so as to enter a collection channel 66 defined behind the deflector plate 56. Ink then flows down the channel 66 for collection and re-circulation. A substantial volume of ink can be retained within the channel 66 so that, even if a relatively large volume of ink is purged onto the orifice plate 59, all of that volume can be deflected into and retained within the channel 66 pending the downward flow of the retained ink into the ink collector at the foot of the deflector plate 56. In the illustrated embodiment, the gap between the edges 64 and 65 is 1 mm, and the channel 66 into which that gap opens has a rectangular cross-section with a length of 4 mm and a width of 1 mm.

Ink flowing down the channel 66 flows onto a projection 67 arranged over a cavity formed in the base of the assembly which forms an ink collection vessel. A grub screw is positioned within that vessel which can be manually adjusted so as to just touch the projection 67 onto which ink flows, thereby facilitating the flow of ink into the collector and minimising the risk of a large drop of ink forming at the base of the channel 66 and thereby minimising the risk of the channel 66 becoming filled with ink so that some ink could emerge in the forward direction from the channel 66.

Referring now to FIGS. 18 to 21, an embodiment of a four section reservoir functionally equivalent to that described with reference to FIG. 11 is illustrated. The assembly comprises a machined casting 68 divided by three partitions 69, 70 and 71 into an uppermost section 72, a lowermost section 73, an upper intermediate section 74 and a lower intermediate section 75. A slot 76 is formed in each of the partitions 69, 70 and 71, each slot defining a lower edge 77 over which ink can overflow from one reservoir to the immediately adjacent lower reservoir. A respective ink outflow passageway 78 communicates with the base of each of the reservoir sections. Each reservoir section receives a level sensing assembly including a float 79. The level sensing assemblies can be of the type described with reference to FIG. 12, each float controlling the position of a magnet the position of which is in turn sensed by a Hall effect sensor (not shown) mounted in a recess on an outer surface of the casing 68.

The mode of operation of the arrangement illustrated in FIGS. 18 to 21 is as described with reference to FIG. 11, that is ink is supplied to the uppermost section 72 whenever any one of the floats 79 falls to a level indicating that the reservoir within which that float is located is substantially empty.

The casing 68 shown in FIGS. 18 to 21 is in use closed by a top plate (not shown) having a central air inlet aperture, a baffle plate being located immediately beneath the closure plate so as to distribute incoming air evenly over all of the four reservoir sections. This avoids the possibility of a sudden inrush of air displacing ink from a reservoir section located beneath the air inlet.

The invention claimed is:

1. An apparatus for cleaning an inkjet printer printhead which defines an elongate array of orifices from which in use jets of ink are projected into a space within which substrates to be printed are presented, comprising:

an gas curtain generator fixed in position relative to the printhead and extending along one side only of the elongate array of orifices so as to direct a curtain of gas across the array of orifices wherein the one side extends between opposing ends of the array of orifices, and across a portion of the printhead which is open to the said space and which is on the side of the array of orifices remote from the gas curtain generator, wherein the curtain of gas is unconstrained while flowing across the portion of the printhead and in the space within which the substrates to be printed are present.

2. An apparatus according to claim 1, wherein the gas curtain is directed to flow in a direction perpendicular to the elongate array of orifices.

3. An apparatus according to claim 1, wherein an ink-receiving opening extends along the side of the array of orifices, the curtain of gas being directed across the array of orifices towards the opening.

4. An apparatus according to claim 3, wherein the opening has a width of from 0.5 mm to 1.5 mm.

5. An apparatus according to claim 4, wherein the opening has a width of approximately 1 mm.

6. An apparatus according to claim 1, wherein the gas curtain generator comprises an elongate slot extending along said one side of the array of orifices and gas pump for pumping gas through the slot towards the orifices.

7. An apparatus according to claim 6, wherein the slot is defined between a body adjacent the printhead and an edge of a plate secured to the body, a gas inlet communicating with a space defined between the body and the plate.

8. An apparatus according to claim 6, wherein the slot has a width of from 0.1 mm to 0.3 mm.

9. An apparatus according to claim 8, wherein the slot has a width of substantially 0.2 mm.

10. An apparatus according to claim 6, wherein the gas pump delivers gas to the slot at a pressure of from 100,000 to 600,000 Pa (1 to 6 bar) above atmospheric pressure.

11. An apparatus according to claim 10, wherein the said pressure is 300,000 Pa (3 bar).

12. An apparatus according to claim 1, comprising a pressure applicator to apply a pressure pulse to ink within the printhead sufficient to discharge ink from the orifices.

13. An apparatus according to claim 12, wherein the pressure pulse has a relatively rapidly rising leading edge and a relatively slowly falling trailing edge.

14. An apparatus according to claim 13, wherein the pulse has a duration from initiation of the leading edge to initiation of the trailing edge of less than 1 second.

15. An apparatus according to claim 14, wherein the said duration is less than 300 ms.

16. An apparatus according to claim 15, wherein the said duration is less than 100 ms.

17. An apparatus according to claim 16, wherein the said duration is from 10 ms to 30 ms.

18. An apparatus according to claim 12, wherein the pressure applicator limits the maximum pressure applied to the ink to 300,000 Pa (3 bar).

19. An apparatus according to claim 18, wherein the maximum pressure is limited to 100,000 Pa (1 bar).

20. An apparatus according to claim 19, wherein the maximum pressure is limited to a pressure within the range of 20000 to 80000 Pa (0.2 to 0.8 bar).

21. An apparatus according to claim 20, wherein the maximum pressure is limited to a pressure within the range of 40000 to 60000 Pa (0.4 to 0.6 bar).

22. An apparatus according to claim 12, comprising means for applying the pressure pulse after a predetermined number of printing operations have been performed by projecting ink from the orifices.

23. An apparatus according to claim 22, wherein the predetermined number is 1.

24. An apparatus according to claim 1, comprising a reservoir coupled to the printhead for supplying ink to the orifices, and an ink source coupled to the reservoir, the orifices being arranged in at least two vertically offset groups, the reservoir being divided into vertically offset reservoir sections including a lowermost section and at least one upper reservoir section with each reservoir section being exclusively coupled to a respective group of orifices, and the at least one upper reservoir section being arranged to overflow into the immediately adjacent reservoir section which is spaced there below, wherein each reservoir section includes a detector detecting the level of ink within that section, and the ink source is arranged to deliver ink to the reservoir section which is vertically uppermost if any level detector detects an ink level in the respective reservoir section below a predetermined level.

25. An apparatus according to claim 24, comprising a volume control for controlling the volume of ink delivered to the reservoir in response to an ink demand initiated by detection of an ink level in any one reservoir section below the predetermined level, the ink source being operative to deliver a predetermined volume of ink in response to an ink demand, to suspend ink delivery for a predetermined period, and to deliver further ink if an ink demand is indicated after the end of the predetermined period.

26. An apparatus according to claim 24, wherein each reservoir section has housed within it a float which supports a magnet, displacement of the float by a changing ink level causing displacement of the magnet relative to a magnetic field sensor supported in a wall of the reservoir section, the magnetic field sensor providing an output indicating a demand for ink if the magnet assumes a predetermined position relative to the magnetic field sensor.

27. An apparatus according to claim 26, wherein the magnetic field sensor is a Hall effect device.

28. An apparatus according to claim 26, wherein the float and magnet are supported on an arm pivotally mounted on the reservoir section wall.

29. An apparatus according to claim 26, wherein the float and magnet are supported on an arm pivotally mounted on a lid of the reservoir.

30. An apparatus for cleaning an inkjet printer printhead which defines an elongate array of orifices from which in use jets of ink are projected into a space within which substrates to be printed are presented, comprising:

an gas curtain generator fixed in position relative to the printhead and extending along one side only of the array of orifices so as to direct a curtain of gas across the array of orifices and across a portion of the printhead which is open to the said space and which is on the side of the array of orifices remote from the gas curtain generator, wherein the curtain of gas is unconstrained while flowing across the portion of the printhead and in the space within which the substrates to be printed are present, wherein an ink-receiving opening extends along the side of the array of orifices, the curtain of gas being directed across the array of orifices towards the opening, and wherein the opening is defined by a gap between a deflector on a side of the opening remote from the array of orifices and an edge of a surface of the printhead in which the orifices are formed, wherein the deflector has a front surface traversing a plane defined by a front surface of the printhead including the array of orifices.

31. An apparatus according to claim 30, wherein an ink-receiving channel is defined behind the deflector, the ink-receiving channel opening into the gap and extending to a lower edge of the deflector.

32. An apparatus according to claim 31, comprising an ink collector located beneath a bottom end of the ink-receiving channel.

33. An apparatus according to claim 32, wherein the bottom end of the channel is positioned to deliver ink to a formation on which ink will accumulate and which is in contact with or closely spaced from a surface defined by the collector.

34. An apparatus according to claim 33, comprising a manually adjustable screw mounted on the collector and adjustable in position relative to the said formation such that ink on the formation can flow onto the screw and via the screw into the collector.

35. An apparatus according to claim 32, wherein the collector comprises an overflow, means for detecting ink flowing through the overflow, and means for signaling a fault if overflowing ink is detected.

36. An apparatus according to claim 35, wherein the detecting means comprises an emitter and a detector at least one of which is positioned to be at least partially covered by overflowing ink, and means for signaling a fault if an output of the detector indicates an overflow of ink.

37. An apparatus according to claim 36, wherein the emitter and detector are arranged to project from a support surface which is located below the printhead and which is open to the said space within which substrates to be printed are presented, the emitter and detector being connected to a sensing circuit sensitive both to the presence of overflowing ink and to the presence of an object in front of the printhead which reflects emissions from the emitter to the detector.

38. An apparatus according to claim 37, wherein the emitter and detector are angled towards each other and angled upwards.

39. An apparatus for cleaning an inkjet printer printhead which defines an elongate array of orifices from which in use jets of ink are projected into a space within which substrates to be printed are presented, comprising:

an gas curtain generator fixed in position relative to the printhead and extending along one side only of the array of orifices so as to direct a curtain of gas across the array of orifices and across a portion of the printhead which is open to the said space and which is on the side of the array of orifices remote from the gas curtain generator, and an ink-receiver opening extending along a side of the array of orifices opposite to the generator, the curtain of gas being directed across the array of orifices towards the ink-receiver opening, wherein the opening is defined by a gap between a deflector on a side of the opening remote from the array of orifices and an edge of a surface of the printhead in which the orifices are formed, and wherein an edge of the deflector which defines a first side of the gap is set back relative to the surface of the printhead in which the orifices are formed such that said deflector edge is further away from the space within which substrates to be printed are presented than the said edge of the surface of the printhead which defines a second side of the gap.

40. An apparatus according to claim 39, wherein the set back of the said deflector edge is from 0.1 mm to 3 mm.

41. An apparatus according to claim 40, wherein the set back of the said deflector edge is approximately 1 mm.

42. An apparatus according to claim 39, wherein the deflector defines a deflector surface extending from said deflector edge which defines the first side of the gap, the deflector surface being inclined to the curtain of gas so as to deflect the curtain of gas towards the said space within which substrates to be printed are presented.

43. A apparatus according to claim 42, wherein the deflector surface is inclined at an angle of from 10° to 35° to the direction in which the gas curtain flows across the printhead, the angle of inclination being measured between the deflector surface and a line extending from the said edge in tie direction of flow.

44. An apparatus according to claim 43, wherein the said angle is substantially 20°.

45. An apparatus according to claim 42, wherein the deflector surface extends from the said deflector edge to a downstream edge on the side of the deflector edge remote from the array of orifices, a further surface of the apparatus extending from the downstream edge of the deflector in a direction away from the said space within which substrates to be printed are presented.

46. An apparatus according to claim 45, wherein the further surface is inclined to the said deflector surface at an included angle of from 70° to 155°.

47. An apparatus according to claim 46, wherein the included angle is substantially 110°.

48. An apparatus for cleaning an inkjet printer printhead which defines an elongate array of orifices from which in use jets of ink are projected into a space within which substrates to be printed are presented, comprising:

a gas flow curtain generator fixed in position relative to the printhead and extending along one side only of the array of orifices so as to direct a curtain of gas across the array of orifices and across a portion of the printhead which is open to the said space and which is on the side of the array of orifices remote from the gas curtain generator, wherein the curtain of gas is unconstrained while flowing across the portion of the printhead and in the space within which the substrates to be printed are present, and a pressure applicator to apply a pressure pulse to ink within the printhead sufficient to discharge ink from the orifices, wherein the pressure applicator comprises a valve which is switchable between a first condition in which a source of compressed gas is connected to an ink supply arrangement, and a second condition in which the ink supply arrangement is connected to an exhaust conduit which communicates with the atmosphere via an airflow restrictor.

49. An apparatus according to claim 48, in which the airflow restrictor is manually adjustable to enable control of the slope of the trailing edge of the pressure pulse.

50. An apparatus for cleaning an inkjet printer printhead which defines an elongate array of orifices from which in use jets of ink are projected into a space within which substrates to be printed are presented, comprising:

a gas curtain generator fixed in position relative to the printhead and extending along one side only of the array of orifices so as to direct a curtain of gas across the array of orifices and across a portion of the printhead which is open to the said space and which is on the side of the array of orifices remote from the gas curtain generator, wherein the curtain of gas is unconstrained while flowing across the portion of the printhead and in the space within which the substrates to be printed are present;

a reservoir coupled to the printhead for supplying ink to the orifices, and an ink source coupled to the reservoir, the orifices being arranged in at least two vertically offset groups, the reservoir being divided into vertically offset reservoir sections including a lowermost section and at least one upper reservoir section with each reservoir section being exclusively coupled to a respective group of orifices, and the at least one upper reservoir section being arranged to overflow into the immediately adjacent reservoir section which is spaced there below, wherein each reservoir section includes a detector detecting the level of ink within that section, and the ink source is arranged to deliver ink to the reservoir section which is vertically uppermost if any level detector detects an ink level in the respective reservoir section below a predetermined level, and wherein the reservoir sections communicate with a single compartment to which compressed gas is delivered via a single gas inlet to pressurize the ink in the reservoir sections, a baffle being positioned over the gas inlet within the compartment to distribute incoming gas evenly over all the reservoir sections.

51. An apparatus for cleaning an inkjet printer printhead which defines an elongate array of orifices from which in use jets of ink are projected into a space within which substrates to be printed are presented, comprising:

a gas curtain generator fixed in position relative to the printhead and extending along one side only of the array of orifices so as to direct a curtain of gas across the array of orifices and across a portion of the printhead which is open to the said space and which is on the side of the array of orifices remote from the gas curtain generator, wherein the curtain of gas is unconstrained while flowing across the portion of the printhead and in the space within which the substrates to be printed are present;

a reservoir coupled to the printhead for supplying ink to the orifices, and an ink source coupled to the reservoir, the orifices being arranged in at least two vertically offset groups, the reservoir being divided into vertically offset reservoir sections including a lowermost section and at least one upper reservoir section with each reservoir section being exclusively coupled to a respective group of orifices, and the at least one upper reservoir section being arranged to overflow into the immediately adjacent reservoir section which is spaced there below, wherein each reservoir section includes a detector detecting the level of ink within that section, and the ink source is arranged to deliver ink to the reservoir section which is vertically uppermost if any level detector detects an ink level in the respective reservoir section below a predetermined level, and wherein the reservoir sections are defined within a common body partitioned to divide the interior of the body into the reservoir sections, each partition defining an edge over which ink can overflow from a reservoir section on one side of the partition to a reservoir section on the other side of the partition.

52. An inkjet printer comprising:

a print head including a front surface having an array of orifices from which jets of ink project across a space and impinge on a substrate opposite to the front surface;

a gas curtain generator offset to a first side of the array of orifices and the generator projecting a curtain of gas, across the array of orifices and in a direction generally parallel to the front face, a deflector offset to a side of the array of orifices opposite to the first side and the deflector having a front surface extending through a plane defined by the front surface, wherein the deflector receives particles entrained in the gas curtain as the gas curtain impinges on the deflector.

53. An inkjet printer as in claim 52 wherein the deflector includes at least one drip point and the printer further includes a collector immediately below the at least one drip point.

54. An ink jet print head as in claim 52 wherein the deflector includes a forward edge adjacent to the gap, wherein the forward edge is offset from a plane of the front surface in a direction away from the substrate.

55. An ink jet print head as in claim 54 wherein the deflector includes a rear edge offset from the plane of the front surface in a direction towards the substrate.

56. An ink jet print head comprising:

a front surface including an array of nozzle orifices through which ink droplets are projected in a path towards a substrate for printing and said front surface facing a substrate against which ink projected from the nozzles is to be deposited;

a cleaning fluid generator projecting a flow of cleaning fluid across the front surface and over the orifices, wherein the generator is positioned adjacent the front surface and offset on a side of the array of nozzle orifices, and a deflector aligned with the flow of cleaning fluid and separated by a gap from an edge of the front surface, wherein cleaning fluid and particles entrained in the cleaning fluid flow across and over the front surface and impinge on the deflector.

57. A ink jet print head as in claim 56 wherein the deflector is a plate having a front surface exposed to the cleaning fluid flow traversing the gap.

58. An ink jet print head as in claim 57 wherein front surface of the deflector plate forms an angle with respect to the front surface and the angle is between zero degrees and ninety degrees.

59. An ink jet print head as in claim 58 wherein the angle is in a range often degrees to thirty-five degrees.

60. An ink jet print head as in claim 56 wherein the gap is in a range of 0.5 millimeters (mm) to 1.5 mm as determined along a line in a plane of the front surface and from the edge of the front surface to an adjacent edge of the deflector.

61. An ink jet print head as in claim 56 wherein the deflector includes a forward edge adjacent to the gap, wherein the forward edge is offset from a plane of the front surface in a direction away from the substrate.

62. An ink jet print head as in claim 61 wherein the deflector includes a rear edge offset from the plane of the front surface in a direction towards the substrate.

63. An ink jet print head as in claim 56 wherein the cleaning fluid generator generates a curtain of cleaning fluid and the curtain of cleaning fluid flows across the front surface and over the array of orifices.

64. An ink jet print head as in claim 56 wherein the cleaning fluid is air.

65. A method for cleaning an ink jet print head having a front surface with a nozzle array of ink orifices, a gas nozzle and a deflector, the method comprising:

propelling ink from the nozzle array and towards a substrate for printing on the substrate;

discharging a curtain of gas from the gas nozzle across the front surface and the nozzle array;

cleaning the nozzle array as the curtain of gas flows over the array and entrains particles and ink from the nozzle array of ink orifices, and collecting the entrain particles and ink as the curtain of gas first reaches the deflector after passing over the nozzle array of ink orifices, wherein the deflector has a surface extending across a plane defined by the front surface.

66. A method as in claim 65 further comprising draining the particles and ink from the deflector and into a collector.

67. A method as in claim 65 further comprising tilting the surface of the deflector such that it forms an angle with respect to the front surface and the angle is in a range of ten degrees to thirty-five degrees.

68. A method as in claim 65 wherein a gap extends between the deflector and an edge formed by the front surface and a side of the pint head, and the gap extends along a line in a plane of the front surface.

69. A method as in claim 68 wherein the gap is in a range of 0.5 millimeters (mm) to 1.5 mm as determined.

* * * * *